US007793938B2

(12) United States Patent
Watanabe

(10) Patent No.: US 7,793,938 B2
(45) Date of Patent: Sep. 14, 2010

(54) PRIZE ACQUISITION GAME APPARATUS AND OPERATION SYSTEM THEREOF

(75) Inventor: Hideki Watanabe, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 1082 days.

(21) Appl. No.: 11/329,266

(22) Filed: Jan. 11, 2006

(65) Prior Publication Data

US 2006/0170164 A1 Aug. 3, 2006

(30) Foreign Application Priority Data

Jan. 12, 2005 (JP) ..... 2005-005647

(51) Int. Cl.
*A63B 71/00* (2006.01)

(52) U.S. Cl. ..... 273/447

(58) Field of Classification Search ..... 273/447; 901/14, 15, 41
See application file for complete search history.

(56) References Cited

U.S. PATENT DOCUMENTS

| | | | | |
|---|---|---|---|---|
| 5,009,429 | A * | 4/1991 | Auxier | 273/240 |
| 5,358,219 | A * | 10/1994 | Shenk et al. | 254/269 |
| 5,415,417 | A * | 5/1995 | Reis, Jr. | 273/447 |
| 5,653,446 | A * | 8/1997 | Lin | 273/447 |
| 6,234,487 | B1 * | 5/2001 | Shoemaker, Jr. | 273/447 |
| 6,283,475 | B1 * | 9/2001 | Stubben | 273/448 |
| 6,428,008 | B1 * | 8/2002 | Singer | 273/447 |
| 6,550,774 | B1 * | 4/2003 | Stroll et al. | 273/447 |
| 6,598,881 | B1 * | 7/2003 | Shoemaker, Jr. | 273/447 |
| 6,634,940 | B2 * | 10/2003 | Yoshida et al. | 463/7 |
| 6,773,016 | B2 * | 8/2004 | Ochi | 273/448 |
| 6,921,076 | B1 * | 7/2005 | Norton | 273/447 |
| 7,063,326 | B1 * | 6/2006 | Smart | 273/447 |
| 7,080,840 | B1 * | 7/2006 | Chen | 273/447 |
| 2002/0067002 | A1 * | 6/2002 | Yoshida et al. | 273/447 |
| 2003/0011133 | A1 * | 1/2003 | Uedono et al. | 273/447 |
| 2003/0090065 | A1 * | 5/2003 | Carter, Jr. et al. | 273/447 |
| 2003/0151202 | A1 * | 8/2003 | Fisher et al. | 273/447 |
| 2005/0218602 | A1 * | 10/2005 | Watanabe et al. | 273/447 |
| 2006/0170164 | A1 * | 8/2006 | Watanabe | 273/447 |
| 2007/0013139 | A1 * | 1/2007 | Kumagai | 273/448 |
| 2007/0029734 | A1 * | 2/2007 | Fukazawa et al. | 273/447 |
| 2007/0210523 | A1 * | 9/2007 | Verstraeten | 273/447 |

FOREIGN PATENT DOCUMENTS

| | | | |
|---|---|---|---|
| JP | 08107978 A | * | 4/1996 |
| JP | 2003-164662 | | 6/2003 |

* cited by examiner

*Primary Examiner*—Peter DungBa Vo
*Assistant Examiner*—Seng Heng Lim
(74) *Attorney, Agent, or Firm*—Finnegan, Henderson, Farabow, Garrett & Dunner, L.L.P.

(57) ABSTRACT

Foremost provided is a prize acquisition game apparatus capable of alleviating the burden of the difficulty adjustment operation, and secondly provided is an operating system of a prize acquisition game apparatus capable of promoting the efficiency in operating a prize acquisition game apparatus. In each of the prize acquisition game apparatuses, provided is a detection unit for detecting the respective types of arm and claw mounted on a catching unit, wherein an information processing terminal transmits an externally input search criterion to a server, and the server creates a search database associating the type of prize and the respective types of arm and claw based on the respective types of prize, arm and claw transmitted from each of the prize acquisition game apparatuses, and extracts from the search database the respective types of arm and claw according to the search criterion transmitted from the information processing terminal and transmits this to the information processing terminal.

9 Claims, 24 Drawing Sheets

FIG.4
(A)
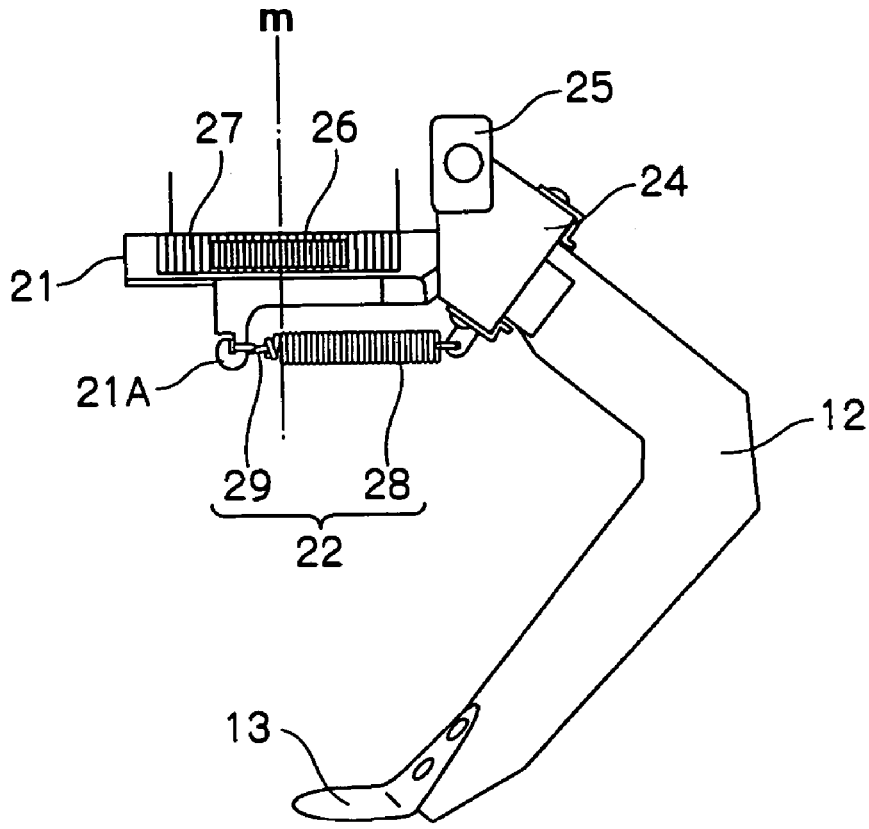
(B)
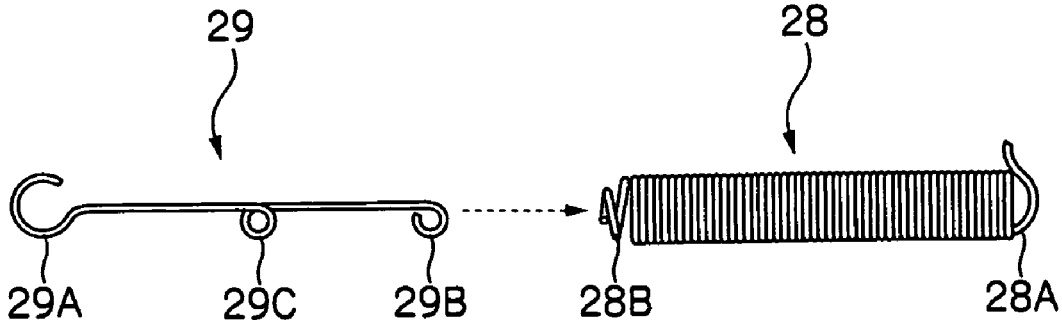

FIG.14

(A)

| TIME | CABINET IDENTIFICATION CODE | PRIZE IDENTIFICATION CODE |
|---|---|---|
| 2004/10/25 17:14:00 | IKEBUKURO1A | SONIC2 |
| 2004/10/25 17:21:00 | IKEBUKURO1B | BEAR3 |

| SETTING STATUS | PAYOUT FLAG |
|---|---|
| PRICE:1 GRIPPING POWER:50 ARM:LARGE CLAW:SMALL SPRING:MEDIUM | NO PAYOUT |
| PRICE:2 GRIPPING POWER:10 ARM:MEDIUM CLAW:MEDIUM SPRING:MEDUIM | PAYOUT |

D1

(B)

| START TIME | CUMULATIVE TIME(H) | CABINET IDENTIFICATION CODE | PRIZE IDENTIFICATION CODE |
|---|---|---|---|
| 2004/10/1 18:14:00 | 140 | IKEBUKURO1A | SONIC2 |
| 2004/10/10 23:30:00 | 210 | IKEBUKURO1A | SONIC2 |
| 2004/10/18 10:21:00 | 98 | IKEBUKURO1B | BEAR3 |

| SETTING STATUS | NUMBER OF GAMES PLAYED | NUMBER OF PAYOUTS | PAYOUT RATIO |
|---|---|---|---|
| PRICE:1 GRIPPING POWER:30 ARM:LARGE CLAW:SMALL SPRING:MEDIUM | 1021 | 101 | 9.9% |
| PRICE:1 GRIPPING POWER:50 ARM:LARGE CLAW:SMALL SPRING:MEDUIM | 1440 | 224 | 15.6% |
| PRICE:2 GRIPPING POWER:10 ARM:MEDIUM CLAW:MEDIUM SPRING:MEDUIM | 450 | 96 | 21.3% |

D2

(C)

| PRICE | GRIPPING POWER | ARM | CLAW | SPRING |
|---|---|---|---|---|
| 1 | 50 | LARGE | SMALL | MEDUIM |

D3

(D)

| PRICE | GRIPPING POWER | ARM | CLAW | SPRING |
|---|---|---|---|---|
| 1 | 50 | LARGE | SMALL | MEDUIM |

D4

FIG.23

(A)

| CABINET IDENTIFICATION CODE | PRIZE IDENTIFICATION CODE |
|---|---|
| IKEBUKURO1A | SONIC2 |
| IKEBUKURO1A | SONIC2 |
| IKEBUKURO1B | BEAR3 |
| . | . |
| . | . |
| . | . |

D10

(B)

| TIME | CABINET IDENTIFICATION CODE |
|---|---|
| 2004/10/25 17:14:00 | IKEBUKURO1A |
| 2004/10/25 17:21:00 | IKEBUKURO1B |

| SETTING STATUS | PAYOUT FLAG |
|---|---|
| PRICE:1 GRIPPING POWER:50 ARM:LARGE CLAW:SMALL SPRING:MEDIUM | NO PAYOUT |
| PRICE:2 GRIPPING POWER:10 ARM:MEDIUM CLAW:MEDIUM SPRING:MEDUIM | PAYOUT |

D11

(C)

| TIME | CABINET IDENTIFICATION CODE | PRIZE IDENTIFICATION CODE |
|---|---|---|
| 2004/10/25 17:14:00 | IKEBUKURO1A | SONIC2 |
| 2004/10/25 17:21:00 | IKEBUKURO1B | BEAR3 |

| SETTING STATUS | PAYOUT FLAG |
|---|---|
| PRICE:1 GRIPPING POWER:50 ARM:LARGE CLAW:SMALL SPRING:MEDIUM | NO PAYOUT |
| PRICE:2 GRIPPING POWER:10 ARM:MEDIUM CLAW:MEDIUM SPRING:MEDUIM | PAYOUT |

D12

(D)

| START TIME | CUMULATIVE TIME(H) | CABINET IDENTIFICATION CODE | PRIZE IDENTIFICATION CODE |
|---|---|---|---|
| 2004/10/1 18:14:00 | 140 | IKEBUKURO1A | SONIC2 |
| 2004/10/10 23:30:00 | 210 | IKEBUKURO1A | SONIC2 |
| 2004/10/18 10:21:00 | 98 | IKEBUKURO1B | BEAR3 |

| SETTING STATUS | NUMBER OF GAMES PLAYED | NUMBER OF PAYOUTS | PAYOUT RATIO |
|---|---|---|---|
| PRICE:1 GRIPPING POWER:30 ARM:LARGE CLAW:SMALL SPRING:MEDIUM | 1021 | 101 | 9.9% |
| PRICE:1 GRIPPING POWER:50 ARM:LARGE CLAW:SMALL SPRING:MEDUIM | 1440 | 224 | 15.6% |
| PRICE:2 GRIPPING POWER:10 ARM:MEDIUM CLAW:MEDIUM SPRING:MEDUIM | 450 | 96 | 21.3% |

D13

PRIZE ACQUISITION GAME APPARATUS AND OPERATION SYSTEM THEREOF

CROSS-REFERENCES TO RELATED APPLICATIONS

This application relates to and claims priority from Japanese Patent Application No. 2005-5647, filed on Jan. 12, 2005, the entire disclosure of which is incorporated herein by reference.

BACKGROUND

The present invention relates to a prize acquisition game and an operating system thereof, and is suitably employed in a prize acquisition game apparatus for acquiring a prize by opening and closing a plurality of arms and in an operating system for operating such prize acquisition game apparatus.

A prize acquisition game apparatus such as a crane game machine for acquiring a prize housed inside a cabinet is often established in game arcades as well as general shops and shopping malls since the operation thereof is amusing and a player's challenge spirit is challenged through the use of popular characters or the like as the prize. Conventionally, various types of such prize acquisition game apparatus have been proposed and commercialized (for instance, refer to Japanese Patent Laid-Open Publication No. 2003-164662).

SUMMARY

Meanwhile, as a conventional prize acquisition game apparatus, for instance, there are those in which a prize acquisition unit for acquiring the prize is directly related to the prize as with the foregoing crane game machine, and those which are not. Further, as the prize of a prize acquisition game apparatus, there are various types of prizes in different shapes, sizes and materials. In particular, with a prize acquisition game apparatus in which the prize acquisition unit is directly related to the prize, characteristics such as the shape of the prize will significantly affect the degree of payout.

Thus, with a prize acquisition game apparatus in which the prize acquisition unit is directly related to the prize, it is necessary to change the difficulty setting of the game to match the characteristics of the prize, and, if this is neglected, loss may occur due to the excess payout of prizes or customers may disassociate themselves due to the insufficient payout of prizes. Contrarily, with this type of prize acquisition game apparatus, if the difficulty can be set appropriately at an early stage, it will be possible to efficiently operate the prize acquisition game apparatus.

Nevertheless, since the game difficulty of a prize acquisition game apparatus is usually decided based on the combination of several control elements, it is difficult to search and set, at an early stage, a game difficulty that is appropriate for the prize at such time.

Further, in order to search the appropriate game difficulty at an early stage, it is necessary to constantly manage (recognize, record) the current setting status of the respective control elements in light of the current profit status, and change the setting status as required. Nevertheless, among such control elements, there are those in which the management of the current status and change in setting can be automatically controlled with a CPU (Central Processing Unit), and those which cannot.

Specifically, as control elements for adjusting the difficulty in a prize acquisition game apparatus which catches and transports a prize as with a crane game machine, for example, there are the following control elements:

1) Shape or material of the arm of a prize acquisition unit to catch the prize;
2) Shape or material of the claw mounted on the tip of the arm;
3) Degree of so-called swinging or vibration for swinging or vibrating the prize acquisition unit for making the caught, scooped or hooked prize easier to fall;
4) Degree of so-called shifting for delaying the response of the crane game machine in relation to the player's operation; and
5) Degree of catching strength for the prize acquisition unit to catch the prize.

Among the above, although the management of the current status and change in setting can be automatically controlled for certain components among 3), 4) and 5) above, it is not possible to perform the foregoing operations automatically for the remaining components.

And, with respect to the control elements in which the management of the current status and change in setting cannot be automatically controlled, it is necessary to manually perform such management of the current status and change in setting, and much labor and time will be required therefor. Further, this kind of manual configuration procedure or setting change procedure often entails erroneous confirmation or erroneous setting, and there is a problem in that it is difficult to set a highly reliable game difficulty.

Therefore, if a scheme can be conceived for searching the appropriate game difficult at an early stage in a prize acquisition game apparatus where such game difficulty is decided based on the combination of several control elements as described above, it is considered that the efficiency in the operation of the prize acquisition game apparatus can be promoted. Moreover, if it is possible to automatically manage certain control elements of the prize acquisition game apparatus, which could not be automatically managed conventionally, it is considered that a highly reliable game difficulty can be set.

The present invention was devised in consideration of the foregoing points, and an object thereof is to provide a prize acquisition game apparatus and an operating system thereof capable of promoting the efficiency in operating the prize acquisition game apparatus.

In order to achieve the foregoing object, the present invention provides a prize acquisition game apparatus for catching and acquiring a prize, having: a catching unit for responding to an external operation and moving within a predetermined space; an arm mounted exchangeably on the catching unit for catching the prize; a claw mounted exchangeably on the arm; a detection unit for detecting the respective types of arm and claw mounted on the catching unit; a storage unit for storing the arm type and claw type; and a control unit for associating the arm type and claw type detected with the detection unit and storing this in the storage unit.

As a result, according to this prize acquisition game apparatus, the current setting status of the arm and claw can be automatically or semi-automatically recognized, and this recognition result can be utilized in the operational management of the prize acquisition game apparatus.

Further, the present invention also provides a prize acquisition game apparatus for catching and acquiring a prize, having: a catching unit for responding to an external operation and moving within a predetermined space; an arm mounted exchangeably on the catching unit for catching the prize; a claw mounted exchangeably on the arm; a notification unit for notifying the type of arm and claw; and a control unit for causing the notification unit to notify the arm type and claw type provided externally to be mounted on the catching unit.

As a result, according to this prize acquisition game apparatus, since a worker will be able to immediately recognize the type of arm and claw to be mounted on the catching unit, it will be possible to spare the worker's trouble required in the confirmation procedure of the current setting status upon changing such arm and claw.

Moreover, the present invention also provides an operating system of a prize acquisition game where one or more prize acquisition games for catching and acquiring a prize, an information processing terminal and a server are communicably connected via a network; wherein each of the prize acquisition game apparatuses has: a catching unit for responding to an external operation and moving within a predetermined space; an arm mounted exchangeably on the catching unit for catching the prize; a claw mounted exchangeably on the arm; a detection unit for detecting the respective types of arm and claw mounted on the catching unit as well as the type of prize; and a transmission unit for transmitting to the server the respective types of prize, arm and claw detected with the detection unit; wherein the information processing terminal transmits to the server an externally input search criterion upon searching the arm type and claw type to be mounted on the catching unit of the prize acquisition game apparatus; and wherein the server creates a search database associating the type of prize and the respective types of arm and claw based on the respective types of prize, arm and claw transmitted from each of the prize acquisition game apparatuses, and extracts from the search database the respective types of arm and claw according to the search criterion transmitted from the information processing terminal and transmits this to the information processing terminal.

As a result, according to this operating system of a prize acquisition game apparatus, it will be possible to immediately detect the arm type and claw type coinciding with the desired search criterion through the use of an information processing terminal.

In addition, the present invention also provides an operating system of a prize acquisition game where one or more prize acquisition games for catching and acquiring a prize, an information processing terminal and a server are communicably connected via a network; wherein each of the prize acquisition game apparatuses has: a catching unit for responding to an external operation and moving within a predetermined space; an arm mounted exchangeably on the catching unit for catching the prize; a claw mounted exchangeably on the arm; a detection unit for detecting the respective types of arm and claw mounted on the catching unit; and a transmission unit for transmitting to the server the respective types of arm and claw detected with the detection unit and cabinet identifying information unique to the prize acquisition game apparatus given in advance; wherein the information processing terminal transmits to the server externally input prize identifying information showing the type of prize per prize acquisition game apparatus and the cabinet identifying information of the prize acquisition game apparatus, and externally input search criterion upon searching the arm type and claw type to be mounted on the catching unit of the prize acquisition game apparatus; and wherein the server creates a search database associating the type of prize and the respective types of arm and claw having the same cabinet identifying information based on the arm type and claw type as well as the cabinet identifying information transmitted from the prize acquisition game apparatus, and the prize identifying information and the cabinet identifying information per prize acquisition game apparatus transmitted from the information processing terminal, and extracts from the search database the respective types of arm and claw according to the search criterion transmitted from the information processing terminal and transmits this to the information processing terminal.

As a result, according to this operating system of a prize acquisition game apparatus, it will be possible to immediately detect the arm type and claw type coinciding with the desired search criterion through the use of an information processing terminal.

According to the present invention, by providing a prize acquisition game apparatus for catching and acquiring a prize, having: a catching unit for responding to an external operation and moving within a predetermined space; an arm mounted exchangeably on the catching unit for catching the prize; a claw mounted exchangeably on the arm; a detection unit for detecting the respective types of arm and claw mounted on the catching unit; a storage unit for storing the arm type and claw type; and a control unit for associating the arm type and claw type detected with the detection unit and storing this in the storage unit, the current setting status can be automatically recognized, and the result of such automatic recognition can be utilized in the operational management of the prize acquisition game apparatus. A prize acquisition game apparatus capable or promoting the efficiency in operation can be realized thereby.

Further, according to the present invention, by providing a prize acquisition game apparatus for catching and acquiring a prize, having: a catching unit for responding to an external operation and moving within a predetermined space; an arm mounted exchangeably on the catching unit for catching the prize; a claw mounted exchangeably on the arm; a notification unit for notifying the type of arm and claw; and a control unit for causing the notification unit to notify the arm type and claw type provided externally to be mounted on the catching unit, it will be possible to spare the worker's trouble required in the confirmation procedure of the current setting status, and a prize acquisition game apparatus capable of alleviating the burden on procedures for controlling the game difficulty can be realized.

Moreover, according to the present invention, by providing an operating system of a prize acquisition game where one or more prize acquisition games for catching and acquiring a prize, an information processing terminal and a server are communicably connected via a network; wherein each of the prize acquisition game apparatuses has: a catching unit for responding to an external operation and moving within a predetermined space; an arm mounted exchangeably on the catching unit for catching the prize; a claw mounted exchangeably on the arm; a detection unit for detecting the respective types of arm and claw mounted on the catching unit as well as the type of prize; and a transmission unit for transmitting to the server the respective types of prize, arm and claw detected with the detection unit; wherein the information processing terminal transmits to the server an externally input search criterion upon searching the arm type and claw type to be mounted on the catching unit of the prize acquisition game apparatus; and wherein the server creates a search database associating the type of prize and the respective types of arm and claw based on the respective types of prize, arm and claw transmitted from each of the prize acquisition game apparatuses, and extracts from the search database the respective types of arm and claw according to the search criterion transmitted from the information processing terminal and transmits this to the information processing terminal, it will be possible to immediately detect the arm type and claw type coinciding with the desired search criterion through the use of an information processing terminal, and an operating system of a prize acquisition game apparatus capable of promoting the efficiency in operating the prize acquisition game apparatus can be realized. Furthermore, according to the present invention, even when handling the same prize under temporally (date and time) and spatially (location) different circumstances, an index for performing the optimum operation can be obtained. Moreover, when introducing a new prize with no past records, by referring to the records of a prize with of a similar nature, an effect is yielded in that an index for performing the optimum operation can be obtained.

In addition, according to the present invention, by providing an operating system of a prize acquisition game where one or more prize acquisition games for catching and acquiring a prize, an information processing terminal and a server are communicably connected via a network; wherein each of the prize acquisition game apparatuses has: a catching unit for responding to an external operation and moving within a predetermined space; an arm mounted exchangeably on the catching unit for catching the prize; a claw mounted exchangeably on the arm; a detection unit for detecting the respective types of arm and claw mounted on the catching unit; and a transmission unit for transmitting to the server the respective types of arm and claw detected with the detection unit and cabinet identifying information unique to the prize acquisition game apparatus given in advance; wherein the information processing terminal transmits to the server externally input prize identifying information showing the type of prize per prize acquisition game apparatus and the cabinet identifying information of the prize acquisition game apparatus, and externally input search criterion upon searching the arm type and claw type to be mounted on the catching unit of the prize acquisition game apparatus; and wherein the server creates a search database associating the type of prize and the respective types of arm and claw having the same cabinet identifying information based on the arm type and claw type as well as the cabinet identifying information transmitted from the prize acquisition game apparatus, and the prize identifying information and the cabinet identifying information per prize acquisition game apparatus transmitted from the information processing terminal, and extracts from the search database the respective types of arm and claw according to the search criterion transmitted from the information processing terminal and transmits this-to the information processing terminal, it will be possible to immediately detect the arm type and claw type coinciding-with the desired search criterion through the use of an information processing terminal, and an operating system of a prize acquisition game apparatus capable of promoting the efficiency in operating the prize acquisition game apparatus can be realized. Furthermore, according to the present invention, even when handling the same prize under temporally (date and time) and spatially (location) different circumstances, an index for performing the optimum operation can be obtained. Moreover, when introducing a new prize with no past records, by referring to the records of a prize with of a similar nature, an effect is yielded in that an index for performing the optimum operation can be obtained.

DESCRIPTION OF DRAWINGS

FIG. 4(A) is a front view and FIG. 4(B) is an exploded view showing the configuration of the catching unit;

FIG. 14 is a conceptual diagram showing the data configuration of various data in the first embodiment;

FIG. 23 is a conceptual diagram showing the data configuration of various data in the second embodiment;

DETAILED DESCRIPTION

An embodiment of the present invention is now explained in detail with reference to the attached drawings.

(1) First Embodiment

Figure 1:
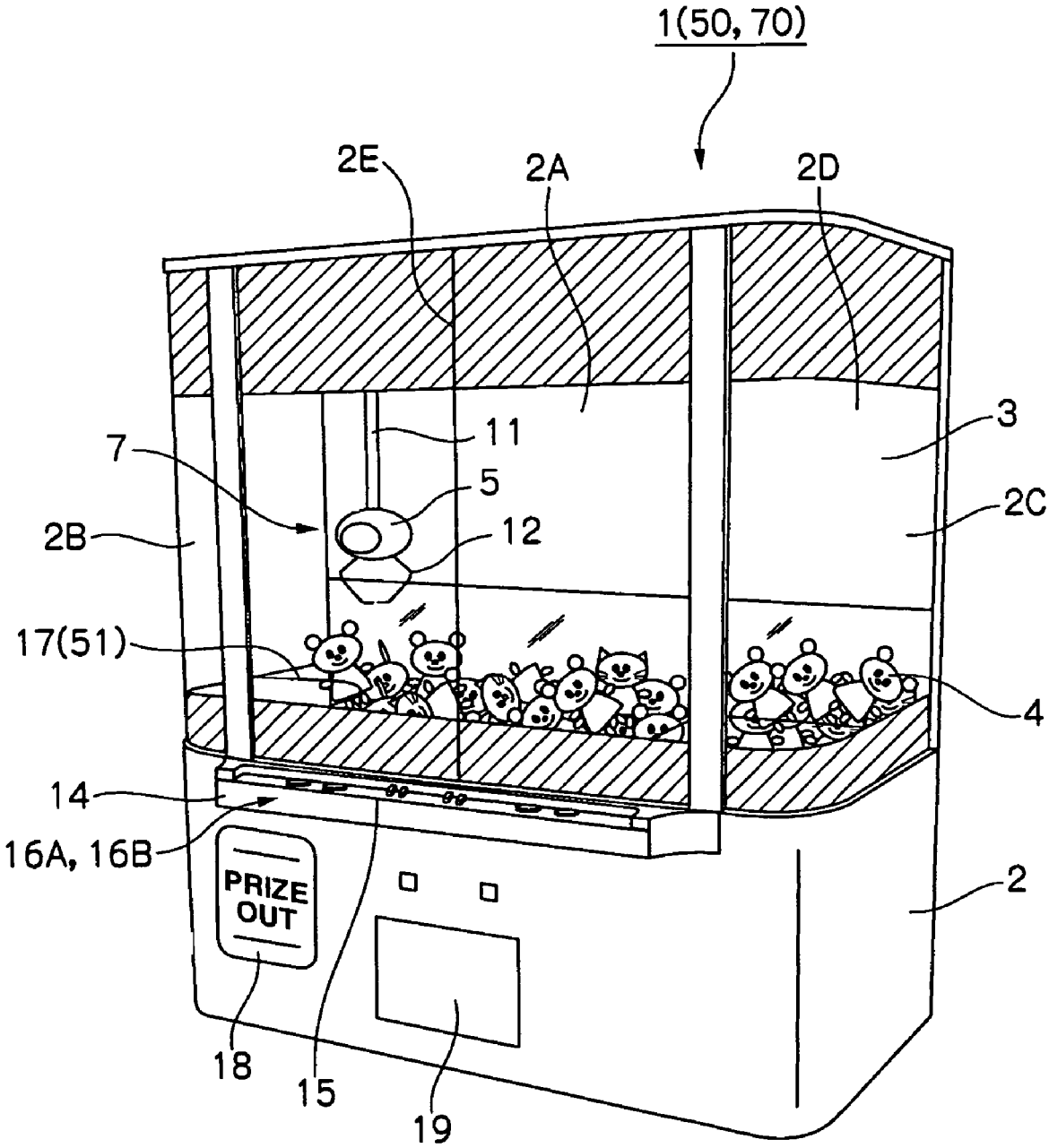
FIG. 1 is a perspective view showing the external configuration of the prize acquisition game apparatus.

(1-1) Configuration of Prize Acquisition Game Apparatus in First Embodiment FIG. 1 shows the overall prize acquisition game apparatus 1 according to the present embodiment, and a box-shaped housing unit 3 is formed on a rectangular base 2. The front face 2A and side faces 2B, 2C of this housing unit 3 are formed from a transparent resin or glass plate-shaped member so that the prizes 4 housed inside the housing unit 3 will be visible. Further, the back face 2D of the housing unit 3 is constituted from a plate-shaped member functioning as a mirror or a decorated plate-shaped member. A sliding door or a gatefold door 2E, for example, is provided to the front face 2A of this housing unit 3, and a store staff is thereby able to house prizes 4 such as stuffed toys of characters or general merchandise in the housing unit 3.

Further, a prize acquisition unit 7 configured from a catching unit 5 for catching the prize and a moving part (FIG. 2) for moving this catching unit 5 within the housing unit according to the player's operation is provided at the upper part of this housing unit 3.

Figure 2:
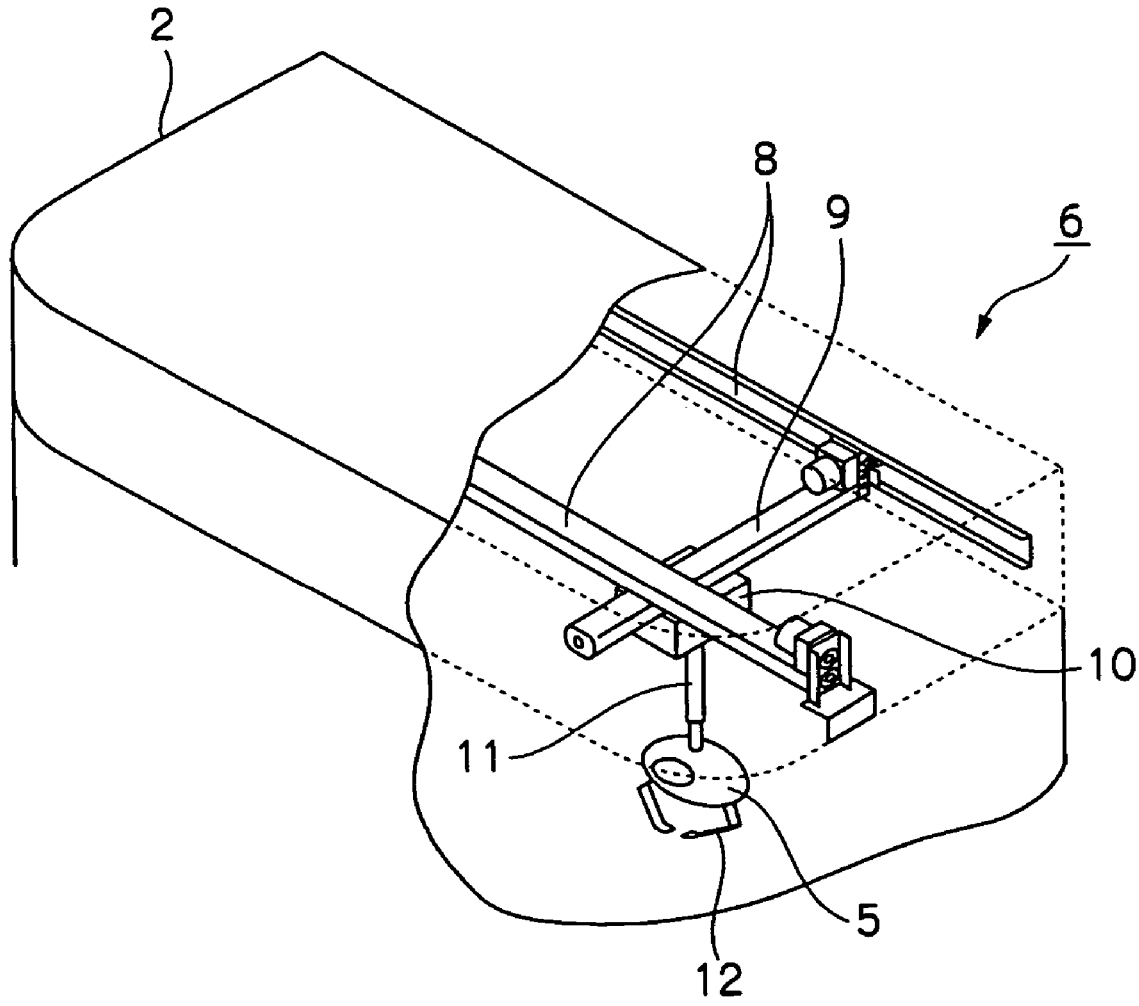
FIG. 2 is a perspective view showing the configuration of the moving part.

As shown in FIG. 2, a moving part 6 has a pair of lateral fixed rails 8 that is fixed and arranged parallel to the lateral direction (X direction) at the inner upper part of the housing unit 3, a longitudinal movable rail 9 mounted slidably to this lateral fixed rail 8 and parallel to the longitudinal direction (Y direction), a prize acquisition base 10 mounted slidably to this longitudinal movable rail 9, and a support 11 mounted retractably parallel to this prize acquisition base 10 in the vertical direction (Z direction). And, the catching unit 5 is mounted on the lower end of this support 11.

Figure 7:
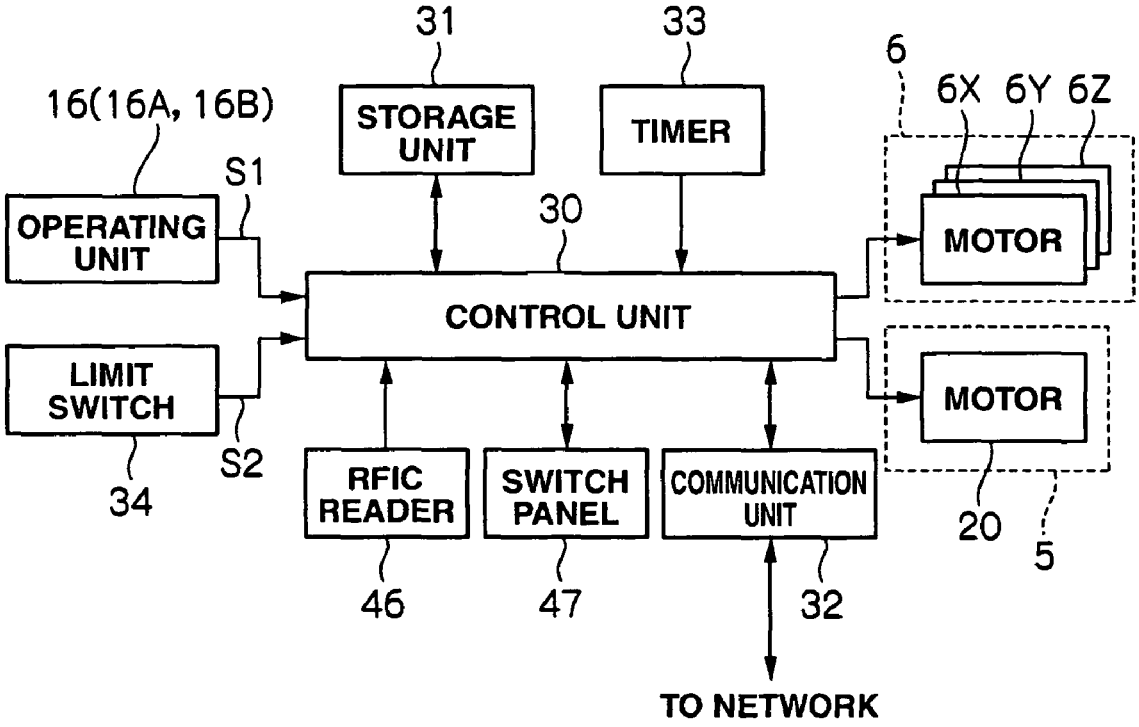
FIG. 7 is a block diagram showing the internal configuration of the prize acquisition game apparatus according to the first embodiment.

Here, the longitudinal movable rail 9 of the moving part 6 can be moved in the lateral direction (X direction) along the lateral fixed rail 8 based on the rotational output of the X direction motor 6X (FIG. 7), and the prize acquisition unit base 10 can be moved in the longitudinal direction (Y direction) along the longitudinal movable rail 9 based on the rotational output of the Y direction motor 6Y (FIG. 7). Further, the support 11 can be retracted based on the rotational output of the Z direction motor 6Z (FIG. 7). Thereby, with the prize acquisition unit 7, the catching unit 5 can be moved to a desired position within the housing unit 3 by operating the X direction motor 6X, Y direction motor 6Y and Z direction motor 6Z of the moving part 6 in a desired state.

Moreover, the catching unit 5 has two openable/closable arms 12 respectively having a claw 13 (FIG. 3) mounted on the tip thereof, and is able to catch a prize 4 by closing and opening these arms 12. Here, the respective arms 12 are exchangeably mounted on the catching unit 5, and the respective claws 13 are exchangeably mounted on the corresponding arms 12, and, the game difficulty can be adjusted by exchanging these arms 12 and claws 13.

Meanwhile, an operator console 14 is provided to the base 2, and this operator console 14 is provided with a coin slot 15 for inserting a coin upon playing the game, and an operating unit 16 including a first operation switch 16A for the player playing the game to input operations for moving the catching unit 5 to a desired position in the lateral direction, and a second operation switch 16B for the player to input operations for moving the catching unit 5 to a desired position in the longitudinal direction. Incidentally, this operating unit 16 can be configured from another operation unit such as a joystick.

Further, provided to the front face side of the base 2 is a prize output port 18 in communication with a cylindrical prize drop-in guide 17 provided to a prescribed position inside the housing unit 3, and, as described later, the prize 4 caught with the catching unit 5, transported and dropped in the prize drop-in guide 17 can be removed from this output port 18.

Moreover, an opening-closing door 19 is provided to the front face side of the base 2. And, a switch panel 47 (FIG. 12) described later, a liquid crystal touch panel (not shown) and so on for making various settings in this prize acquisition game apparatus are housed inside the opening-closing door 19 in an open state, and, thereby, the administrator is able to set the various items to one's desired state while visually confirming the switch panel 12 or contents displayed on the liquid crystal touch panel.

Figure 3:
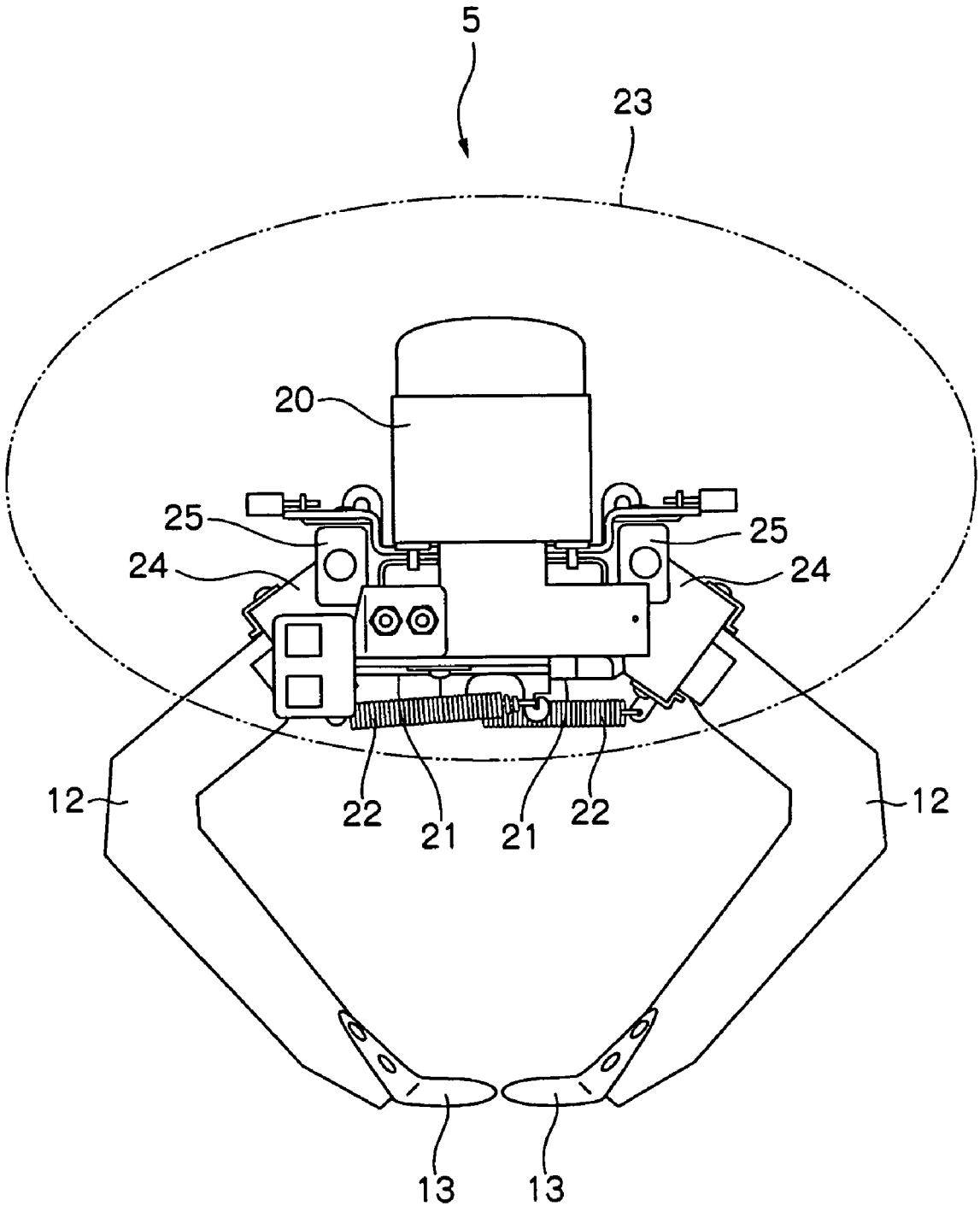
FIG. 3 is a front view showing the configuration of the catching unit.

Here, FIG. 3 and FIG. 4 show specific configurations of the catching unit 5. As evident from FIG. 3, the catching unit 5 has a motor 20 as the source of power, an arm opening-closing member 21 for opening and closing the arm 12 based on the rotational output of this motor 20, and a spring unit 22 for deciding the maximum catching strength upon catching the prize 4 with the arm 12, and a part thereof including the motor 20 is covered with a cover 23. The respective arms 12 are tiltably and detachably mounted on a bracket 25 via a rear anchor member 24, and the respective claws 13 are screwed to the open end of these arms 12.

Further, as shown in FIG. 4(A), a pinion 26 is mounted on the tip of the output axis of the motor 20, and a rack 27 is fastened to the inner face of the arm opening-closing member 21 in parallel to a spring unit 22 so as to engage with this pinion 26, and, thereby, the arm opening-closing member 21 can be moved, integrally with the rack 27, in a direction toward or away from the rear anchor member 24 by driving the motor 20 forward or in reverse.

Further, the spring unit 22, as shown in FIG. 4(B), is configured from a coil spring 28 and a rod-shaped pin 29, and one end 29A of the pin 29 is mounted on a spring bearing member 21A provided to the arm opening-closing member 21. Further, the other end 29B of the pin 29 is inserted into a coil spring 28, and a whorl-like curled portion for preventing the pin 29 from becoming hooked inside the coil sprint 28 is formed at the end thereof. Moreover, a locking part 29C for preventing the pin 29 from falling out from the other end 28B of the coil spring 28 is formed at roughly the center of the pin 29.

In the coil spring 28, the one end 28A is mounted on the rear anchor member 24 of the arm 12, and the other end 28B is inserted into the pin 29. The diameter of the end of this coil spring 28 to which the pin 29 is to be inserted is formed to be small so as to prevent the pin 29 from falling out.

As a result of the foregoing configuration, when the rear anchor member 24 is pushed by the arm opening-closing member 21 and moves toward the direction of releasing the arm 12 upon opening the arm 12, since the pin 29 will move in the releasing direction without having to extend the coil spring 28 until the locking part 29C of the pin 29 reaches the other end 28B of the coil spring 28, it will be possible to prevent the coil spring 28 from extending and generating bias. Further, the spring bearing member 21A provided to the arm opening-closing member 21 will move when the rack 27 is moved, and, upon extending the coil spring 28, the extension of the coil spring 28 can be prevented since only the pin 29 will move together with the arm opening-closing member 21 A until the locking part 29C reaches the other end 28B of the coil spring 28.

Incidentally, in a state where the locking part 29C reaches the other end 28B of the coil spring 28, slacking of the coil spring 28 can be prevented since the portion from the locking part 29C to the other end 29B of the pin 29 is inserted into the coil spring 28.

Next, the opening and closing movement of the arm 12 in this catching unit 5 is explained. With this catching unit 5, the arm 12 is closed in the initial state. Further, as shown in FIG. 5(A), a large part of the pin 29 of the spring unit 22 is positioned inside the coil spring 29.

And, upon opening the arm 12, as shown in FIG. 5(B), the pinion 26 rotates in a clockwise direction as a result of the motor 20 being driven in normal rotation, and the rack 27 and arm opening-closing member 21 thereby move toward the rear anchor member 25. As a result, the rear anchor member 25 is pushed by one end of the arm opening-closing member 21 and the arm 12 is released thereby.

Meanwhile, when closing the arm 12, as shown in FIG. 5(C), the pinion 26 rotates in a counterclockwise direction as a result of the motor 20 being driven in reverse rotation, and the rack 27 and arm opening-closing member 21 thereby move toward the center of the catching unit 5. As a result, the arm 12 is closed pursuant to the movement of this arm opening-closing member 21. Incidentally, the motor 20 will continue rotating until the rack 27 and arm opening-closing member 21 return to the initial state position illustrated in FIG. 5(A).

FIG. 5(C) shows a state of the catching unit 5 where two arms 12 have caught a prize 4. In comparison to the state depicted in FIG. 5(A), in the state of FIG. 5(C), it is evident that a part of the pin 29 is protruding further from the inside of the coil spring 28, but the coil spring 28 is not extended. Like this, even in a case where the arm 12 catches a prize 4, the bias of the coil spring 28 can be made zero by functioning the pin 29.

Thereafter, the motor 20, as shown in FIG. 5(D), continues its reverse rotation even after the rack 27 has returned to the initial state position. Thereby, the arm opening-closing member 21 will move further away from the rear anchor member 25. In accordance with this, the pin 29 will also move in the same direction, and, as a result, the locking part 29C of the pin 29 will engage with the end of the coil spring 28. When the pin 29 is further moved in this state of engagement, the coil spring 28 will extend and bias toward a direction of closing the arm 12 to increase the catching strength of the catching unit 5, and the bias may be changed in an analog manner according to the moving distance of the rack 27.

Figure 5:
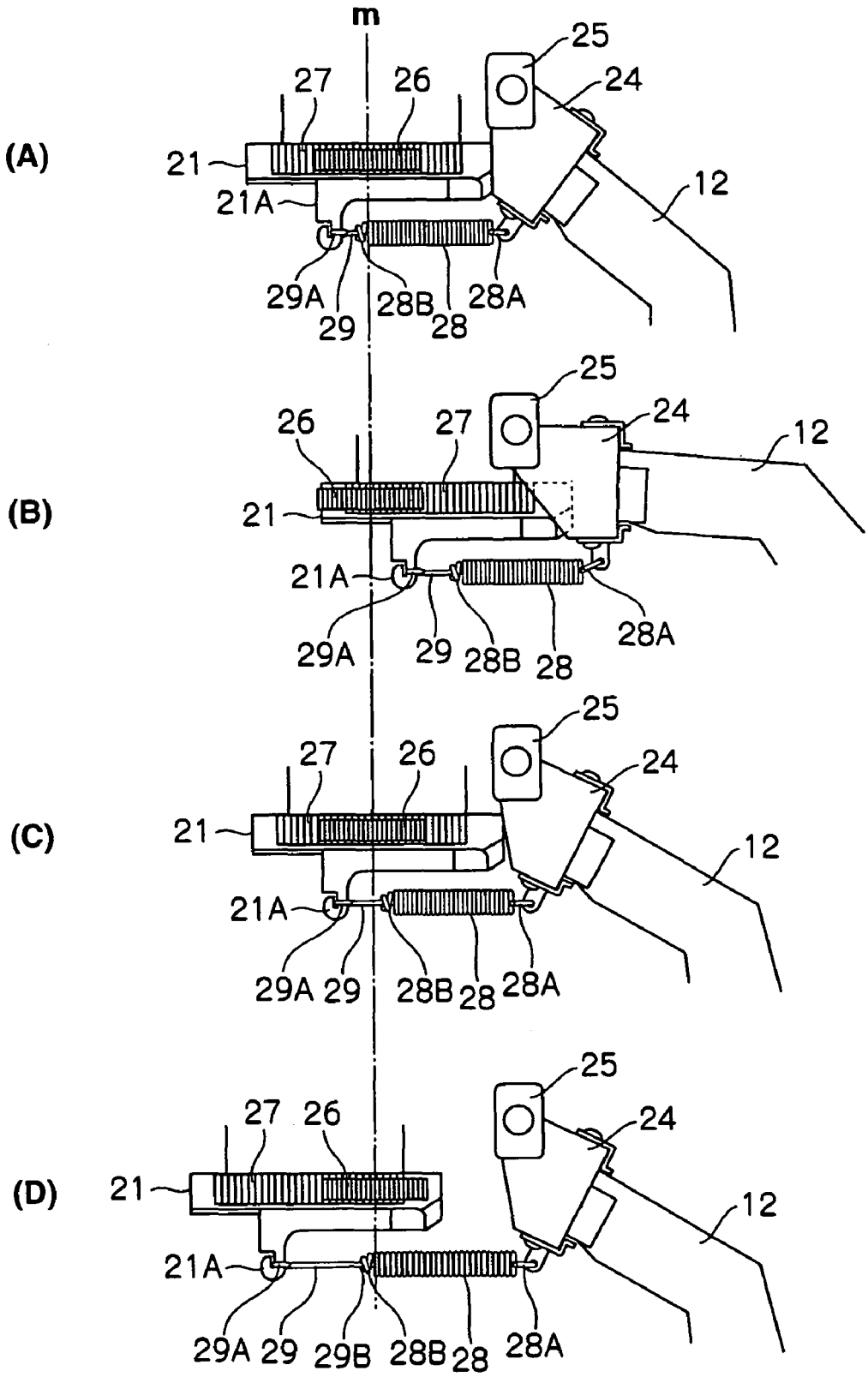
FIG. 5(A) to (D) are front views for explaining the operation of the catching unit.
Figure 6:
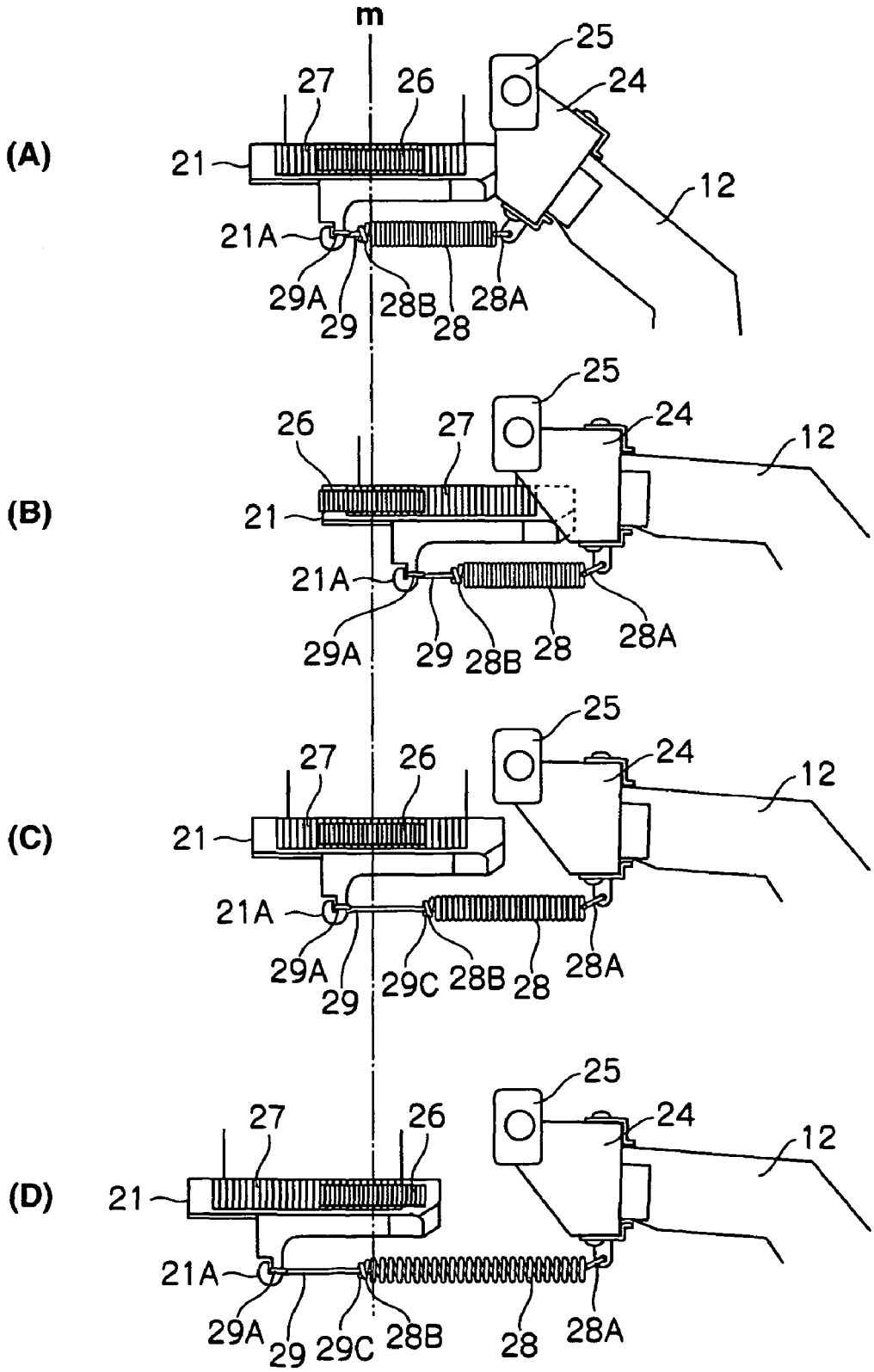
FIG. 6(A) to (D) are front views for explaining the operation of the catching unit.

FIG. 6 shows the state of the catching unit 5 in a case when it catches a prize 4 that is larger than the prize 4 caught with the catching unit 5 in FIG. 5. Accordingly, since the flow from FIG. 6(A) to (B) is the same as the flow from FIG. 5(A) to (B), the explanation thereof is omitted. After the arm 12 is released, the closing operation of the arm 12 is started by the motor 20 rotating in reverse. Here, although the arm 12 will catch the prize 4, since the prize 4 is large, the release angle of the arm 12 will become great. As a result, bias will work such that the other end 28B of the coil spring 28 is pulled toward the center, and the locking part 29C of the pin 29 engaged with the other end 28B of the coil spring 28.

Thereafter, as a result of the motor 20 continuing to rotate in reverse, the arm opening-closing member 21 will move further away from the rear anchor member 25. In accordance with this, the pin 29 will also move away from the rear anchor member 25, and, as a result, as shown in FIG. 6(D), the coil spring 28 will extend further so as to increase the catching strength of the catching unit 5.

Incidentally, the rotation of the motor 20 after the rack 27 and arm opening-closing member 21 return to the initial state position shown in FIG. 5(C) or. FIG. 6(C) is controlled by a control unit 30 described later based on the catching strength set by the administrator. In other words, when the catching strength is set to the maximum of "100", the motor 20 is rotated so that the arm opening-closing member 21 will move a maximum distance away from the rear anchor member 25. Further, when the catching strength is set to a minimum of "1", the rotation of the motor 20 is stopped at the point in time when the arm opening-closing member 21 returns to the initial state position. Moreover, when the catching strength is set between "100" and "1", the motor 20 is rotated so that the arm opening-closing member 21 moves away from the rear anchor member 25 in a distance according to the setting value of the catching strength.

And, the catching strength of the catching unit 5 as described above can be set by inputting a desired number between 1 and 100 as the catching strength of the catching unit 5 with the foregoing liquid crystal touch panel housed in the opening-closing door 17 of the base 1 described above. Incidentally, as the setting input unit for inputting the setting value of the catching strength of the catching unit 5 as described above, in addition to a liquid crystal touch panel, a different setting input unit may be separately provided.

As described above, with this prize acquisition game apparatus 1, by setting the value of the catching strength in the catching unit 5 and adjusting the type (strong, medium, weak) of the coil spring 28 of the spring unit 22, the catching strength upon catching the prize 4 with two arms 12 can be set to the desired strength.

Here, FIG. 7 shows the internal configuration of this prize acquisition game apparatus 1. As evident from FIG. 7, this prize acquisition game apparatus 1 has a control unit 1 configured from a microcomputer and including a CPU (Central Processing Unit), ROM (Read Only Memory) and RAM (Random Access Memory), a storage unit 31 configured from an involatile memory or the like, a communication unit 32 as the interface for communicating with external equipment via a network 44 (FIG. 9) described later, and a timer 33 for counting the current time.

And, for instance, when a first or second operation switch 16A, 16B of an operator console 14 (FIG. 1) is pressed by the player during the game, a corresponding manipulate signal S1 is given to the control unit 30 from such first or second operation switch 16A, 16B. Further, the moving part 6 is provided with limit switches 34 at the respective movement limit positions in the X direction, Y direction or Z direction of the catching unit 5 as the left/right position detection unit for detecting the position of the catching unit 5 in the leftward and rightward directions, front/back position detection unit for detecting the position of the catching unit 5 in the frontward and backward directions, and up/down position detection unit for detecting the position of the catching unit 5 in the upward and downward directions. And, when the catching unit 5 reaches the movement limit position in the corresponding X direction, Y direction or Z direction, these limit switches 34 respectively send a movement limit detection signal S2 to the control unit 30 accordingly.

Figure 8:
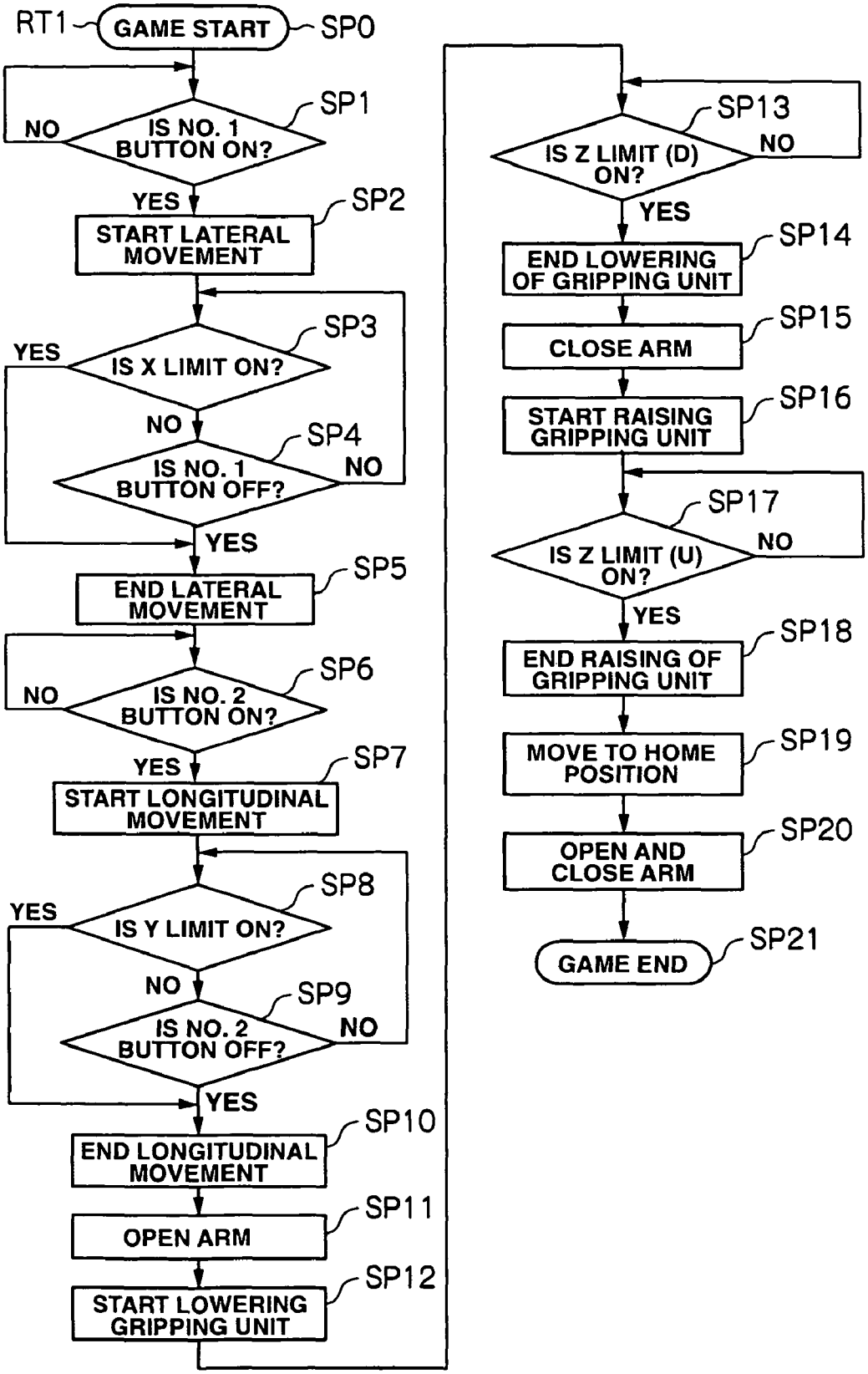
FIG. 8 is a flowchart showing the prize acquisition game execution processing routine.

The control unit 30 thus causes the prize acquisition game apparatus 1 to execute a game operation in response to the operation of the first and second operation switch 16A, 16B by the player according to the prize acquisition game execution processing routine RT1 shown in FIG. 8 based on the manipulate signal S1 and movement limit detection signal S2.

In other words, when the control unit 30 recognizes that a prescribed number of coins for playing a single game has been inserted into the coin slot 15 (FIG. 1), it starts the prize acquisition game execution processing routine RT1 at step SP0, and, at subsequent step SP1, waits for the first operation button 16A (FIG. 1) of the operator console 14 (FIG. 1) to be pressed.

And, when the control unit 30 eventually recognizes that the player pressed the first operation button 16A based on the manipulate signal S1 from the first operation button 16A, it proceeds to step SP2, and operates the X direction motor 6X of the moving part 6 (FIG. 2) so as to start the movement of the catching unit 5, which was positioned at the home position immediately above the prize drop-in guide 15 (FIG. 1) in its initial state, in the lateral direction (X direction).

Next, the control unit 30 proceeds to step SP3, and determines whether the catching unit 5 reached the movement limit position in the lateral direction based on the movement limit detection signal S2 from the corresponding limit switch 34. Further, the control unit 30, at subsequent step SP4, determines whether the pressing of the first operation button 16A is released based on the manipulate signal S1 from the first operation button 16A. Then, upon obtaining a negative result at both step SP3 and step SP4, the control unit 30 returns to step SP3.

Meanwhile, upon obtaining a positive result at either step SP3 or step SP4, the control unit 30 proceeds to step SP5, stops the X direction motor 6X of the moving part 6 so as to end the movement of the catching unit 5 in the lateral direction (X direction), thereafter proceeds to step SP6, and waits for the second operation button 16B (FIG. 1) of the operator console 14 to be pressed.

And, when the control unit 30 eventually recognizes that the second operation button 16B was pressed based on the manipulate signal S1 from the second operation button 16B, it proceeds to step SP7, and operates the Y direction motor 6Y of the moving part 6 so as to start the movement of the catching unit 5 in the longitudinal direction (Y direction).

Thereafter, the control unit 30 proceeds to step SP8, and determines whether the catching unit 5 reached the movement limit position in the longitudinal direction based on the movement limit detection signal S2 from the corresponding limit switch 34. Further, the control unit 30, at subsequent step SP9, determines whether the pressing of the second operation button 16B is released based on the manipulate signal S1 from the second operation button 16B. Then, upon obtaining a negative result at both step SPB and step SP9, the control unit 30 returns to step SP8.

Meanwhile, upon eventually obtaining a positive result at either step SP8 or step SP9, the control unit 30 proceeds to step SP10, stops the Y direction motor 6Y of the moving part 6 so as to end the movement of the catching unit 5 in the longitudinal direction (Y direction), thereafter proceeds to step SP11, and operates the motor 20 (FIG. 3) of the catching unit 5 so as to release the arm 12 of the catching unit 5.

Further, the control unit 30 thereafter proceeds to step SP12 and operates the Z direction motor 6Z of the moving part 6 so as to start lowering the catching unit 5, and then proceeds to step SP13 and waits for the catching unit 5 to reach the movement limit position in the downward direction.

And, when the control unit 30 eventually recognizes that the catching unit 5 reached the movement limit position in the downward direction based on the movement limit detection signal S2 from the limit switch 34, it proceeds to step SP14 and stops the Z direction motor 6Z of the moving part 14 so as to end the lowering of the catching unit 5, and thereafter proceeds to step SP15 and operates the motor 20 of the catching unit 5 so as to close the arm 12.

Next, the control unit 30 proceeds to step SP16 and operates the Z direction motor 6Z of the moving part 6 so as to start raising the catching unit 5, and thereafter proceeds to step SP17 and waits for the catching unit 5 to reach the movement limit position in the upward direction.

And, when the control unit 30 eventually recognizes that the catching unit 5 reached the movement limit position in the upward direction based on the movement limit detection signal S2 from the limit switch 34, it proceeds to step SP18 and stops the Z direction motor 6Z of the moving part 6 so as to end the raising of the catching unit 5, and thereafter proceeds to step SP19 and respectively operates the X direction motor 6X and Y direction motor 6Y of the moving part 6 so as to move the catching unit 5 to the original home position above the prize drop-in guide 17.

Further, the control unit 30 thereafter proceeds to step SP20 and operates the motor 20 of the catching unit 5 so as to open and thereafter close the arm 12 of the catching unit 5 (release operation of the prize 4), and thereafter proceeds to step SP21 and ends this prize acquisition game execution processing routine RT1.

Accordingly, with this prize acquisition game apparatus 1, when the catching unit 5 was able to catch the prize 4, it is carried above the prize drop-in guide 15 in a state where the prize 4 is caught with the arm 12 of the catching unit 5, and drops the prize 4 into the prize drop-in guide 17 as a result of the release operation of the prize 4 with the catching unit 5. Thus, the player is thereby able to remove and acquire such prize 4 from the prize output port 18.

Figure 9:
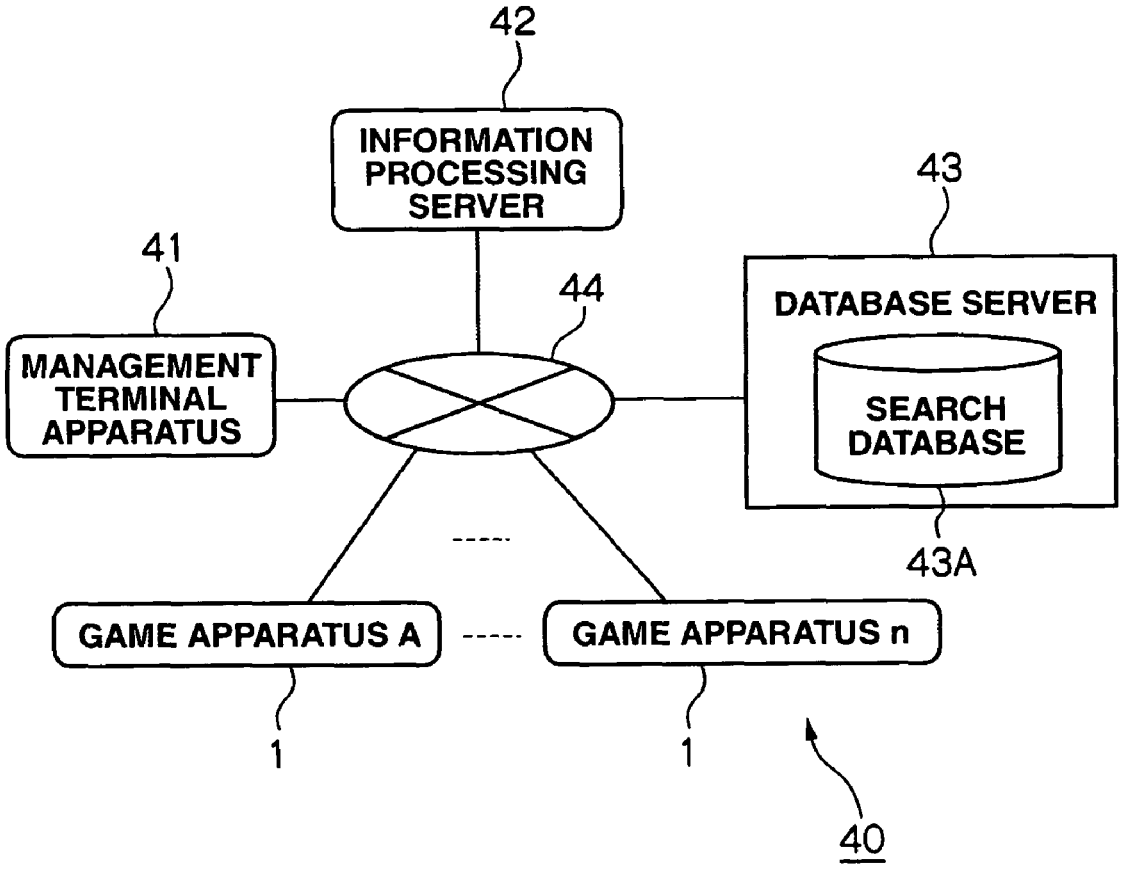
FIG. 9 is a block diagram showing the game apparatus operating system according to the first embodiment.

(1-2) Configuration of Game Apparatus Operating System in Present Embodiment Next, a game apparatus operating system 40 according to the present embodiment is explained. FIG. 9 shows the game apparatus operating system 40 for operating the foregoing prize acquisition game apparatus 1. This game apparatus operating system 40 is configured from a plurality of prize acquisition game apparatuses 1 respectively installed in shopping malls or game arcades, and a management terminal apparatus 41, information processing server 42 and database server 43 of the operating company operating these prize acquisition game apparatuses 1 being mutually connected via a network 44 such as the Internet.

And, with this game apparatus operating system 40, information concerning the type of prize 4 in the respective prize acquisition game apparatuses 1, various setting statuses such as the type of arm 12 and claw (large, medium, small, other) of the catching unit 5 in the prize acquisition game apparatus 1, and payout ratio based on such setting statuses is automatically collected and managed. By the operator of the operating company operating the management terminal apparatus 41 and designating the desired type of prize 4 and the desired payout ratio thereof, it will be possible to search for the setting status such as the type of arm 12 and claw 13 of the catching unit 5 to be set in the prize acquisition game apparatus 1 for paying out the prize 4 at the designated payout ratio, or designate changes in the setting status of the arm 12 and claw 13 in a desired prize acquisition game apparatus based on such search result.

Foremost, configuration of the prize acquisition game apparatus 1 for realizing the foregoing function is explained. The prize acquisition game apparatus 1 is equipped with a function of semi-automatically reading, associating and storing the control elements of game difficulty; namely, the respective types of arm 12 and claw (large, medium, small, other) currently mounted on the catching unit 5 as well as the type of coil spring 28 (strong, medium, weak) of the spring unit 22 in the catching unit 5, and the type of prize 4 housed in the housing unit 2.

Figure 10:
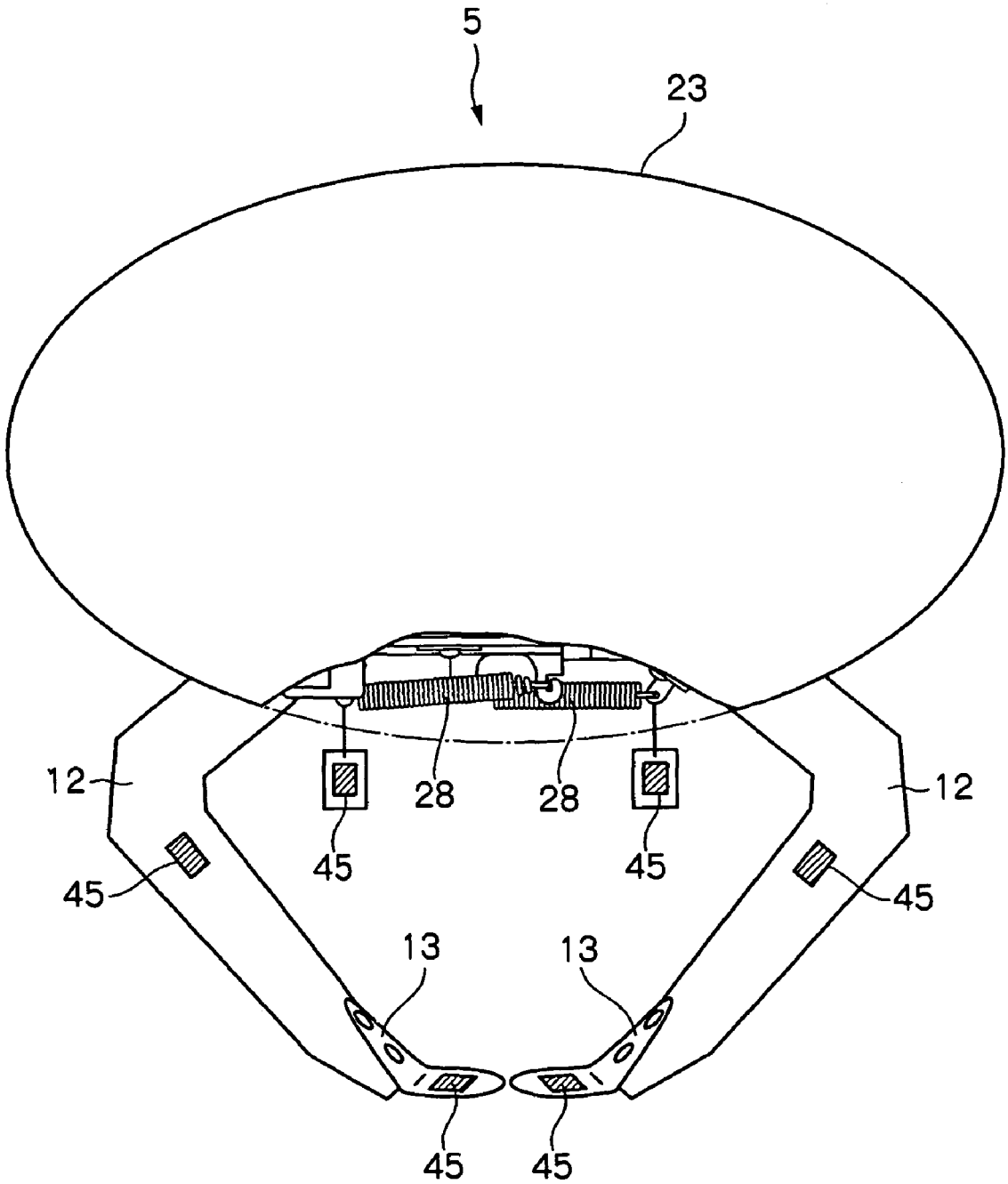
FIG. 10 is a front view showing a state where the RFID is mounted on the catching unit.
Figure 11:
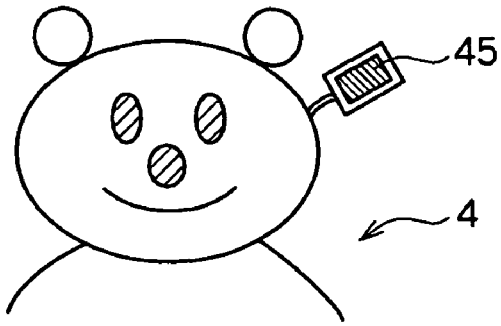
FIG. 11 is a front view for explaining a state where the RFID is mounted on the prize.

In actuality, as the unit for semi-automatically reading the type of arm 12, claw 13 and coil spring 28 mounted on the catching unit 5, as shown in FIG. 10, an RFID (Radio Frequency Identification) chip 45 recording parts category information representing the category of parts (arm 12, claw 13 or coil spring 28) and parts type information representing the type of parts ("large, medium, small, other" or "strong, medium, weak") is mounted on all types of arm 12, claw 13 and coil spring 28. Further, as shown in FIG. 11, the RFID chip 45 recording a prize identifying code for identifying the type of prize 4 is also mounted on the tag of the respective prizes 4.

And, with the prize acquisition game apparatus 1, an RFID reader 46 (FIG. 7) is removably housed inside the opening-closing door 19 of the base 2, and the administrator is thereby able to read the foregoing parts category information and parts type information or prize identifying code recorded in these RFID chips 45 by removing the RFID reader 46 and placing it near the RFID chip 45 mounted on the arm 12, claw 13, coil spring 28 or tag of the prize 4.

Here, the parts category information and parts type information or prize identifying code read by the RFID reader 46, as shown in FIG. 7, is given to the control unit 30. And, the control unit 30 recognizes the respective types of arm 12, claw 13 and coil spring 28 to be mounted on the catching unit 5 based on the parts category information and parts type information provided from the RFID reader 46, and associates such information with the prize identifying code of the prize 4 and the catching strength of the catching unit 5 set at such time, and stores this in the storage unit 31.

Figure 12:
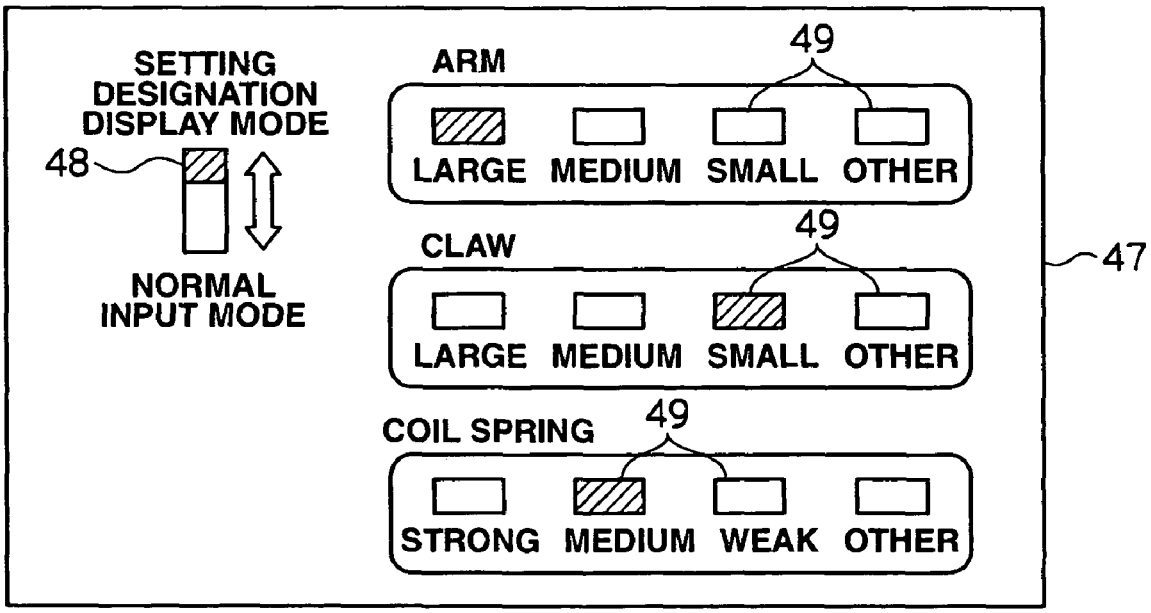
FIG. 12 is a front view showing the configuration of the switch panel.

Incidentally, for instance, a switch panel 47 as shown in FIG. 12 is also provided to the inside of the opening-closing door 19 of the base 2, and, in a state where a switch 48 of the switch panel 47 being switched to the "normal input mode", it is also possible to input the respective types of arm 12, claw 13 and coil spring 28 manually set at such time by pressing an illumination switch 49 respectively corresponding to the type of arm 12 (large, medium, small, other), type of claw 13 (large, medium, small, other) and type of coil spring 28 (strong, medium, weak) mounted on the prize acquisition game apparatus 1 at such time among the respective illumination switches disposed in the respective columns of "arm", "claw" and "coil spring".

In the foregoing case also, the respective types of arm 12, claw 13 and coil spring 28 input via the switch panel 47 are given to the control unit 30. As a result, the control unit 30 recognizes the respective types of arm 12, claw 13 and coil spring 28 set in the catching unit 5 at such time based on this input operation, and, as with the case described above, associates such information with the prize identifying code semi-automatically read from the tag of the prize 4 with the RFID reader 46 and the catching strength of the catching unit 5 set at such time, and stores this in the storage unit 31.

Figure 13:
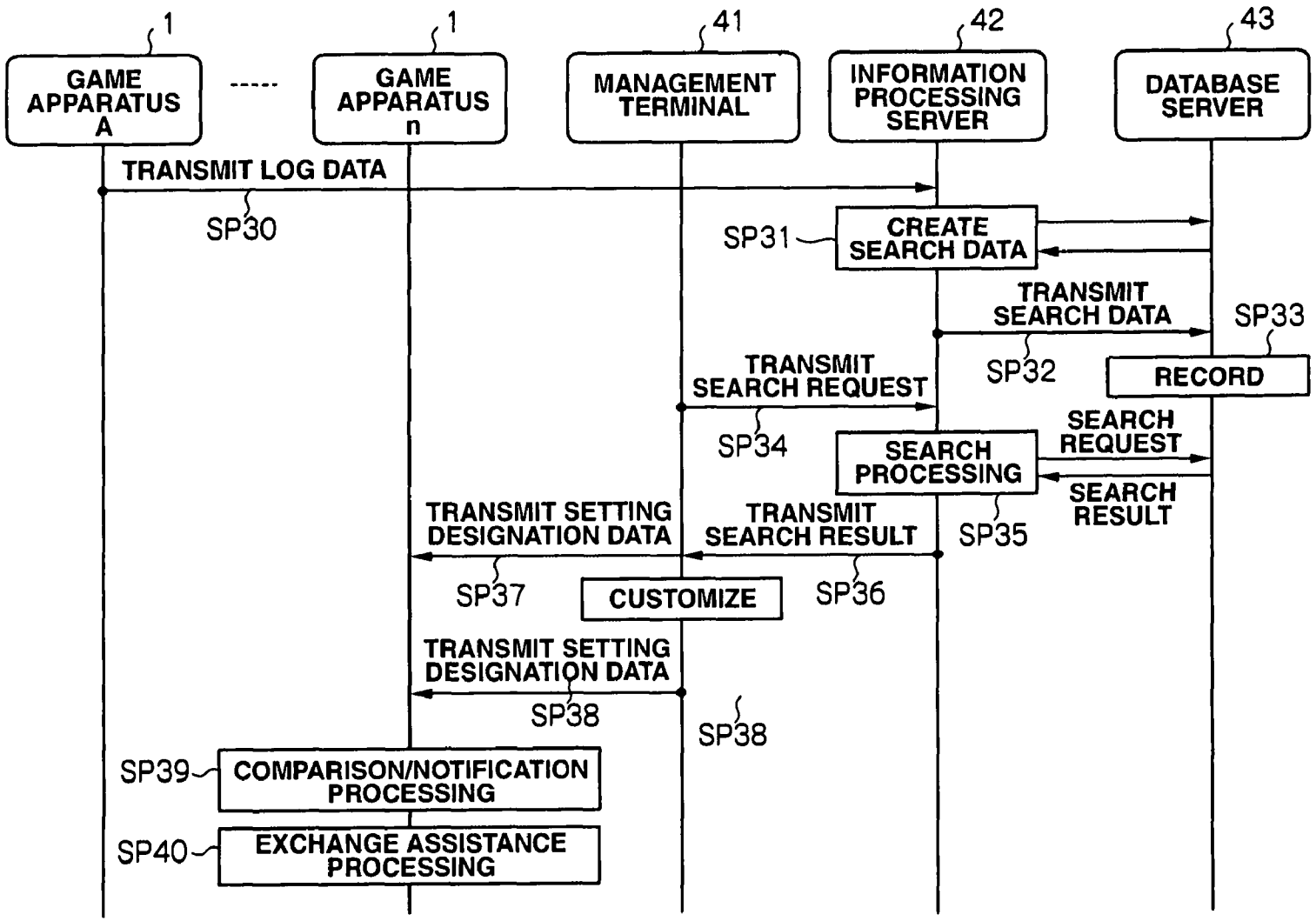
FIG. 13 is a timing chart for explaining the operation of the game apparatus operating system.

Meanwhile, as shown in FIG. 13, the control unit 30 of the respective prize acquisition game apparatuses 1 creates a log data D1 composed of various types of information such as "time", "cabinet identifying code", "prize identifying code", "setting status" and "payout flag" as shown in FIG. 14(A) each time a single game is over based on the respective types of arm 12, claw 13 and coil spring 28 set in the catching unit 5 at such time, prize identifying code of the prize 4 and the catching strength of the catching unit 5 stored in the storage unit 31.

Here, the "time" of log data D1 is information representing the year, month, day and time the game was played (finished), which was acquired from the timer 33 (FIG. 7). Further, "cabinet identifying code" is an identifying code unique to the prize acquisition game apparatus 1 pre-stored in the control unit 30, and "prize identifying code" is an identifying code for identifying the type of prize 4 acquired with the RFID reader 46 as described above. Moreover, "setting status" is setting value of the game fee for playing one game as set in the prize acquisition game apparatus 1 and the catching strength in the catching unit 5, and information on the respective types of arm 12, claw 13 and coil spring 28 currently mounted on the catching unit 5 acquired with the RFID reader 46 as described above. In addition, "payout flag" is a flag representing whether a prize 4 was paid out in the game. And, the control unit 30 transmits this created log data D1 to the information processing server 42 via the communication unit 32 (FIG. 7) as the transmission unit (SP30).

The information processing server 42 has a control unit (not shown) configured from a microcomputer for controlling the overall operation of the information processing server 42, and a transmission unit and reception unit (not shown) for transmitting and receiving necessary data to and from the external equipment such as the prize acquisition game apparatus 1 via the network 44, and, when a log data D1 as described above is transmitted from the prize acquisition game apparatus 1, it creates a search data D2 as shown in FIG. 14(B) based on this log data D1 (SP31), and transmits this created search data D2 to the database server 43 (SP32).

Further, the database server 43, as with the information processing server 42, has a control unit (not shown) configured from a microcomputer for controlling the overall operation of the information processing server 42, and a transmission unit and reception unit (not shown) for transmitting and receiving necessary data to and from the external equipment such as the prize acquisition game apparatus 1 via the network 44, and sequentially registers the search data D2 transmitted from the information processing server 42 in the search database 43A (SP33).

Here, with "cabinet identifying code", "prize identifying code" and "setting status" all being the same log data D1 as a single group, search data D2 is tabulation result upon tabulating the number of games played or payout ratio regarding such group, and is configured from the respective types of information such as "start time", "cumulative time", "cabinet identifying code", "prize identifying code", "setting status", "number of games played", "number of payouts" and "payout ratio".

Among the above, "start time" represents the "time" of the oldest log data D1 belonging to such group, and "cumulative time" represents the cumulative time from the "time" of the oldest log data D1 belong to such group to the "time" of the latest log data D1. Further, "cabinet identifying code", "prize identifying code" and "setting status" respectively represent the "cabinet identifying code", "prize identifying code" and "setting status" common to the log data D1 belong to such group, and "number of games played" represents the number of log data belong to such group; that is, the number of games played in the same prize acquisition game apparatus under the same prize and same setting status. Moreover, "number of payouts" represents the number of log data D1 in which a payout flag is raised among the log data D1 belonging to such group; that is, the number of games in which a prize was paid out among the games played in the same prize acquisition game apparatus under the same prize and same setting status. In addition, "payout ratio" is the payout ratio in such group, and is calculated by multiplying the number of payouts with the number of games played.

Figure 15:
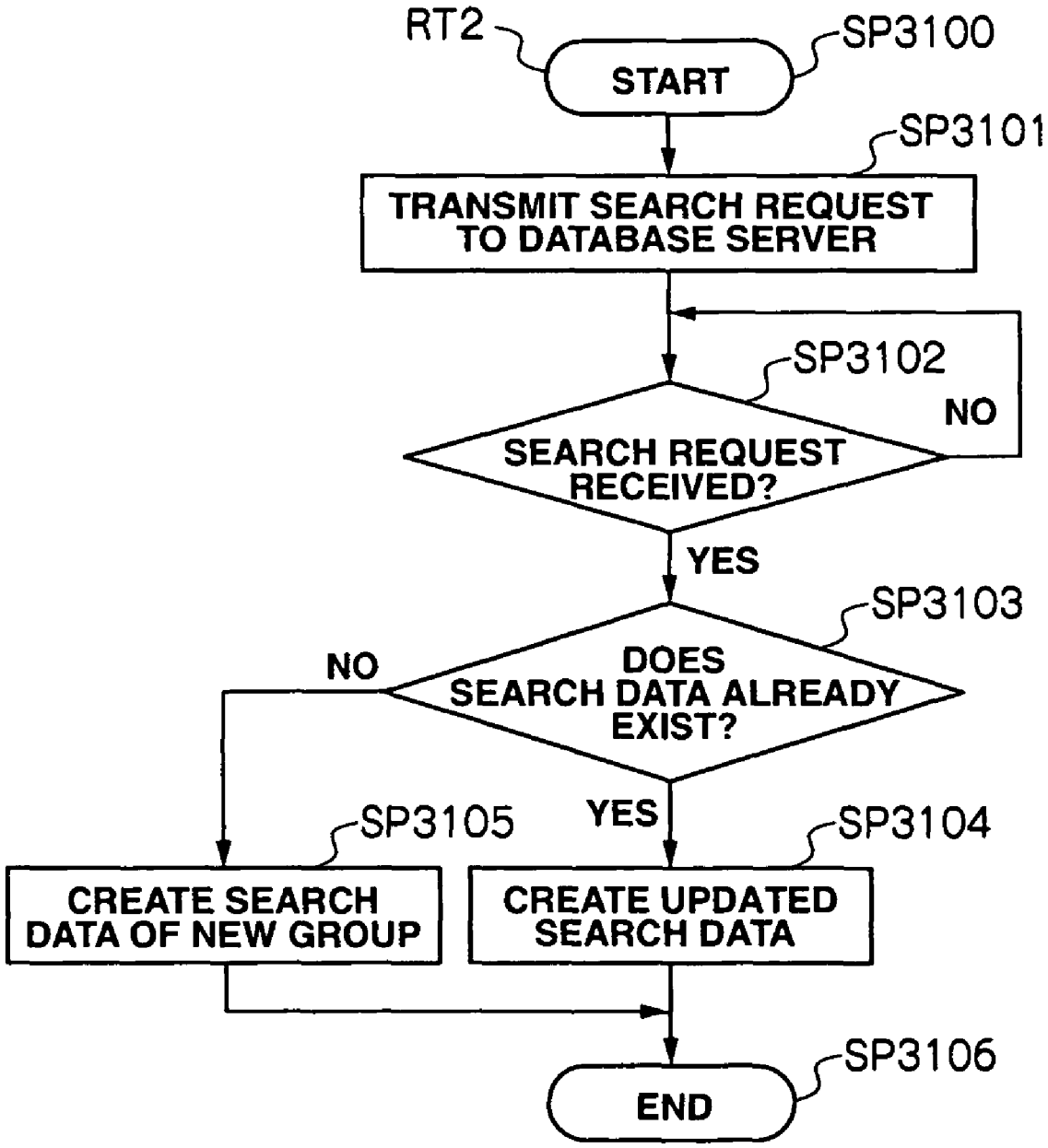
FIG. 15 is a flowchart showing the search data creation processing routine.

FIG. 15 shows the creation processing routine of this kind of search data D2 in the information processing server 42. When the log data D1 is transmitted from the prize acquisition game apparatus 1, the information processing server 42, according to the search data creation processing routine RT2 shown in FIG. 2, updates the search data D2 based on the log data D1 when the search data D2 of the group to which the log data D1 should belong exists in the search database 43A on the one hand, and creates a new search data D2 based on the log data D1 when the search data D2 does not exist in the search database 43A.

In other words, when the log data D1 is transmitted from the prize acquisition game apparatus 1, the information processing server 42 starts this search data creation processing routine RT2 at step SP3100, and, at subsequent step SP3101, transmits a search request to the database server 43 regarding whether the search data D2 of a group to which the log data D1 should belong exists in the search database 43A.

And, the information processing server 42 thereafter proceeds to step SP3102, waits for the search result to be transmitted from the database server 43 in response to the search request, and, upon eventually receiving this search result, it proceeds to step SP3103, and determines whether the search data D2 of the group to which the log data D1 should belong already exists in the search database 43A based on this search result.

When the information processing server 42 obtains a positive result at step SP3103, it proceeds to step SP3104, access the database server 43 to read the search data D2 from the search database 43A, and creates a new search data D2 with the "cumulative time", "number of games played", "number of payouts" and "payout ratio" updated as necessary based on the read search data D2 and log data D1. And, the information processing server 42 thereafter proceeds to step SP3106, and end this search data creation processing routine RT2.

Contrarily, when the iriformation processing server 42 obtains a negative result at step SP3103, it proceeds to step SP3105 and newly creates a search data D2 of a new group to which the log data D1 belongs, thereafter proceeds to step SP3106 and ends this search data creation processing routine RT2. Incidentally, this kind of processing is performed under the control of the foregoing control unit.

Meanwhile, the management terminal apparatus 41 is configured from a versatile personal computer having a control unit (not shown) configured from a microcomputer for controlling the overall operation of the management terminal apparatus 41, a transmission unit and reception unit (not shown) for transmitting and receiving necessary data to and from the external equipment such as the prize acquisition game apparatus 1 via the network 44, and input unit (not shown) configured of a keyboard or mouse for inputting the search criterion upon searching the "setting status" to be set in the prize acquisition game apparatus 1 for obtaining a desired "payout ratio" or the like based on the respective search data D2 registered in the search database 43A in the database server 43.

And, when the operator of an operating company operates the management terminal apparatus 41 to activate the application software for searching the setting status of the prize acquisition game apparatus 1 in relation to the desired prize 4, and inputs the prize identifying code of the prize 4 and the desired payout ratio via the input unit, the management terminal apparatus 41 transmits a corresponding search request to the information processing server 42 via the network 44 (SP34).

When the information processing server 42 receives this search request, it accesses the database server 43 to search whether there is a search data D2 having the "prize identifying code" that is the same as the designated "prize identifying code", and having a "payout ratio" that is the same as or which is similar to the designated "payout ratio" (SP35).

And, when the information processing server 42 detects a corresponding search data D2 based on the foregoing search, it reads the data of the "setting status" in the search data D2 from the database server 43, and transmits this to the management terminal apparatus 41 as a search result data D3 in a format illustrated in FIG. 14(C) (SP36).

As a result, with the management terminal apparatus 41, from the "setting status" to be set in the prize acquisition game apparatus 1 for paying out the prize of the designated "prize identifying code" in the designated "payout ratio"; that is, from the statistical results based on the past log data D1 obtained from the foregoing search based on the search result data D3, the game fee for playing one game, respective types of arm 12, claw 13 and coil spring 28 in the catching unit 5 and the setting value of the catching strength of the catching unit 5, which are considered to enable the payout of the designated prize 4 at the designated "payout ratio" according to such setting, are displayed on a monitor.

And, the operator of the operating company will be able to transmit the foregoing search result data representing the game fee for playing one game, respective types of arm 12, claw 13 and coil spring 28 in the catching unit 5 and the setting value of the catching strength of the catching unit 5 displayed on the monitor of the management terminal apparatus 41 as a setting designation data D4 as shown in FIG. 14(D) for designating the status to be set in a desired prize acquisition game apparatus 1 (SP37).

Further, the operator is also able to change (customize) the respective setting contents of the game fee for playing one game, respective types of arm 12, claw 13 and coil spring 28 in the catching unit 5 and the setting value of the catching strength of the catching unit 5 displayed on the monitor of the management terminal apparatus 41 to a desired state by operating an input unit such as a keyboard or mouse of the management terminal apparatus 41, and is also able to transmit the newly created setting contents as a setting designation data D4 for designating the status to be set in a desired prize acquisition game apparatus 1 (SP38).

Meanwhile, the control unit 30 (FIG. 7) of the prize acquisition game apparatus 1 which received the setting designation data D4 via the communication unit 32 (FIG. 7) as the reception unit compares the respective types of arm 12, claw 13 and coil spring 28 in the designated catching unit 5 obtained based on this setting designation data D4, and the type of arm 12, claw 13 and coil spring 28 currently mounted on one's own catching unit 5. And, when any of the current types of arm 12, claw 13 or coil spring 28 is different from the respective types of designated arm 12, claw 13 and coil spring 28, the control unit 30 notifies the administrator of the prize acquisition game apparatus 1 to such effect (SP39).

Figure 16:
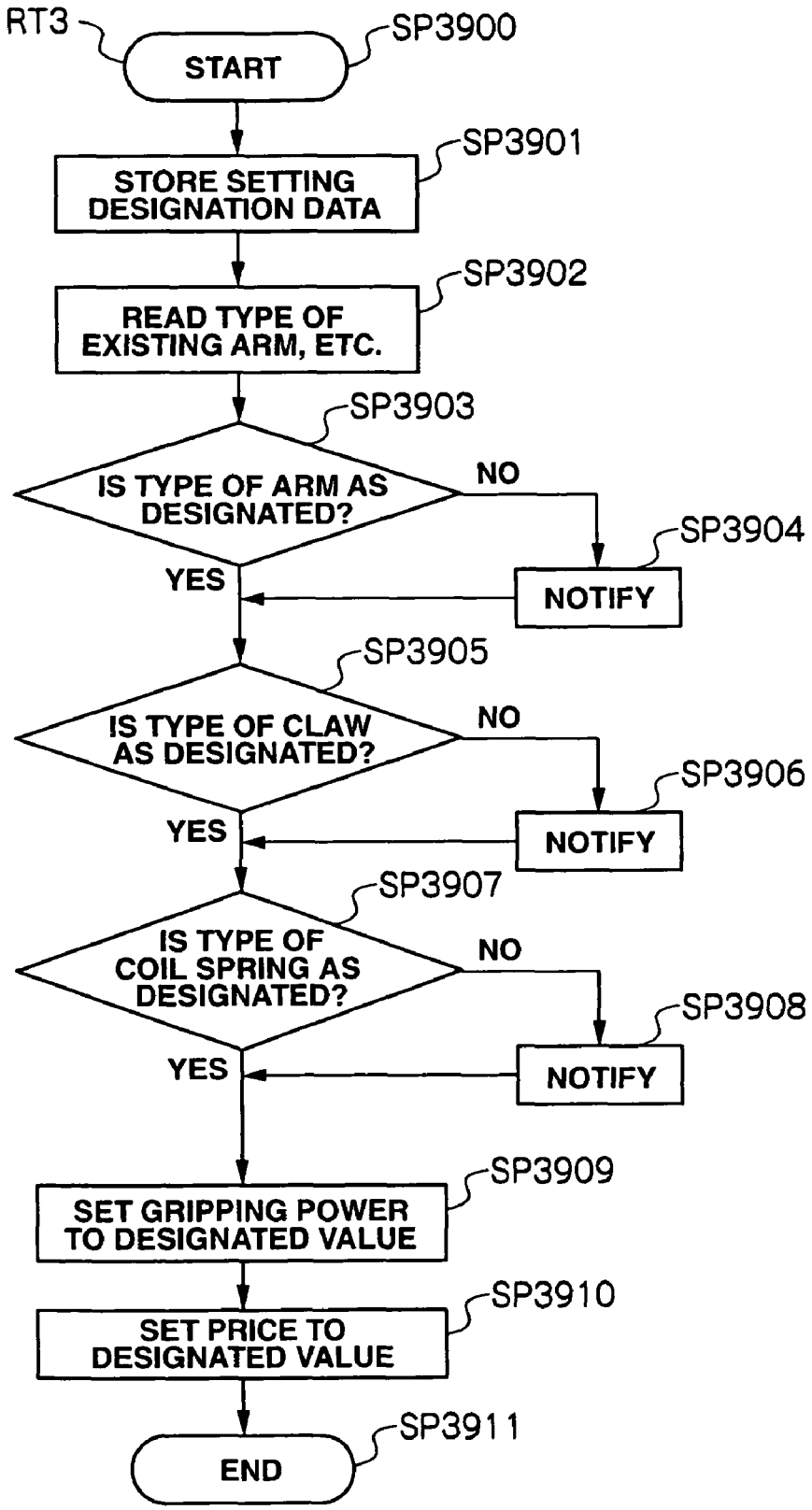
FIG. 16 is a flowchart showing the setting comparison notification processing routine.

FIG. 16 shows the processing routine of the control unit 30 in the foregoing case. In actuality, when the control unit 30 of the prize acquisition game apparatus 1 receives a setting designation data D4 from the management terminal apparatus 41, it starts the setting comparison/notification processing routine RT3 shown in FIG. 16 at step SP3900, and, at subsequent step SP3901, stores this setting designation data D4 in the storage unit 31 (FIG. 7).

Thereafter, the control unit 30 proceeds to step SP3902, and reads the respective types of arm 12, claw 13 and coil spring 28 currently mounted on the catching unit 5 from the storage unit 31. Incidentally, the respective types of arm 12, claw 13 and coil spring 28 stored in the storage unit 31 have been read from the RFID chip 45 (FIG. 10) mounted on the arm 12 with the foregoing RFID reader 46 (FIG. 7).

Next, the control unit 30 proceeds to step SP3903, and determines whether the type of arm 12 currently mounted on the catching unit 5 read from the storage unit 31 at step SP3902 coincides with the type of designated arm 12 recognized based on the setting designation data D4 from the management terminal apparatus 41.

And, when the control unit 30 obtains a positive result at step SP3903, it proceeds to step SP3905, and, when the control unit 30 obtains a negative result, it proceeds to step SP3904 to notify the administrator of the prize acquisition game apparatus 1 to the effect that it obtained a negative result by illuminating a warning lamp (not shown) or outputting a warning alarm from a sound output unit not shown (i.e., a speaker) based on the sound data stored beforehand in the ROM or storage unit 31, and thereafter proceeds to step SP3905.

Further, when the control unit 30 proceeds to step SP3905, it determines whether the type of claw 13 currently mounted on the catching unit 5 read from the storage unit 31 at step SP3902 coincides with the type of designated claw 13 recognized based on the setting designation data D4 from the management terminal apparatus 41.

And, when the control unit 30 obtains a positive result at step SP3905, it proceeds to step SP3907, and, when the control unit 30 obtains a negative result, it proceeds to step SP3906 to notify the administrator of the prize acquisition game apparatus 1 to the effect that it obtained a negative result by illuminating a warning lamp, and thereafter proceeds to step SP3907.

Moreover, when the control unit 30 proceeds to step SP3907, it determines whether the type of coil spring 28 currently mounted on the catching unit 5 read from the storage unit 31 at step SP3902 coincides with the type of designated coil spring 28 recognized based on the setting designation data D4 from the management terminal apparatus 41.

And, when the control unit 30 obtains a positive result at step SP3907, it proceeds to step SP3909, and, when the control unit 30 obtains a negative result, it proceeds to step SP3908 to notify the administrator of the prize acquisition game apparatus 1 to the effect that it obtained a negative result by illuminating a warning lamp, and thereafter proceeds to step SP3909.

In addition, when the control unit 30 proceeds to step SP3909, it changes the setting of the catching strength of the catching unit 5 in the prize acquisition game apparatus 1 to the designated catching strength recognized based on the setting designation data D4 from the management terminal apparatus 41, and, at subsequent step SP3910, it changes the setting of the game fee for playing one game set in the prize acquisition game apparatus 1 to the designated game fee recognized based on the setting designation data D4 from the management terminal apparatus 41. And, the control unit 30 thereafter proceeds to step SP3911, and ends this setting comparison/notification processing routine RT3.

Meanwhile, with the prize acquisition game apparatus 1, when a setting designation data D4 is given from the management terminal apparatus 41 as described above, by thereafter switching the switch 48 to the setting designation display mode described in FIG. 12, it is able to illuminate the illumination switch 49 of the type of arm 12, claw 13 and coil spring 28 corresponding to the types respectively designated from the management terminal apparatus 41.

Therefore, the administrator who receives the foregoing notification from the prize acquisition game apparatus 1 will be able to easily recognize which category and type of arm 12, claw 13 and coil spring 28 should be exchanged by comparing the illumination status of the illumination switches 49 in the respective columns of arm 12, claw 13 and coil spring 28 on the switch panel 47, and the arm 12, claw 13 and coil spring 28 actually mounted on the catching unit 5 at such time.

As a result, the administrator is able to change the necessary parts among the arm 12, claw 13 and coil spring 28 to the designated type while confirming the illumination status of the illumination switches 49 on the switch panel 47. And, after completing this exchange process, the administrator will read the respective RFID chips 45 mounted on each arm 12, claw 13 and coil spring 28 from the RFID reader 46 in a state where the switch 48 of the switch panel 47 is switched to the setting designation display mode.

As a result, in the prize acquisition game apparatus 1, the setting status of each arm 12, claw 13 and coil spring 28 in the catching unit 5 at such time, and the setting status of each designated arm 12, claw 13 and coil spring 28 management terminal apparatus 41 based on the setting designation data D4 transmitted from the management terminal apparatus 41 are compared, and, when any arm 12, claw 13 or coil spring 28 is not yet exchanged to the designated type, this is notified to the prize acquisition game apparatus 1.

Figure 17:
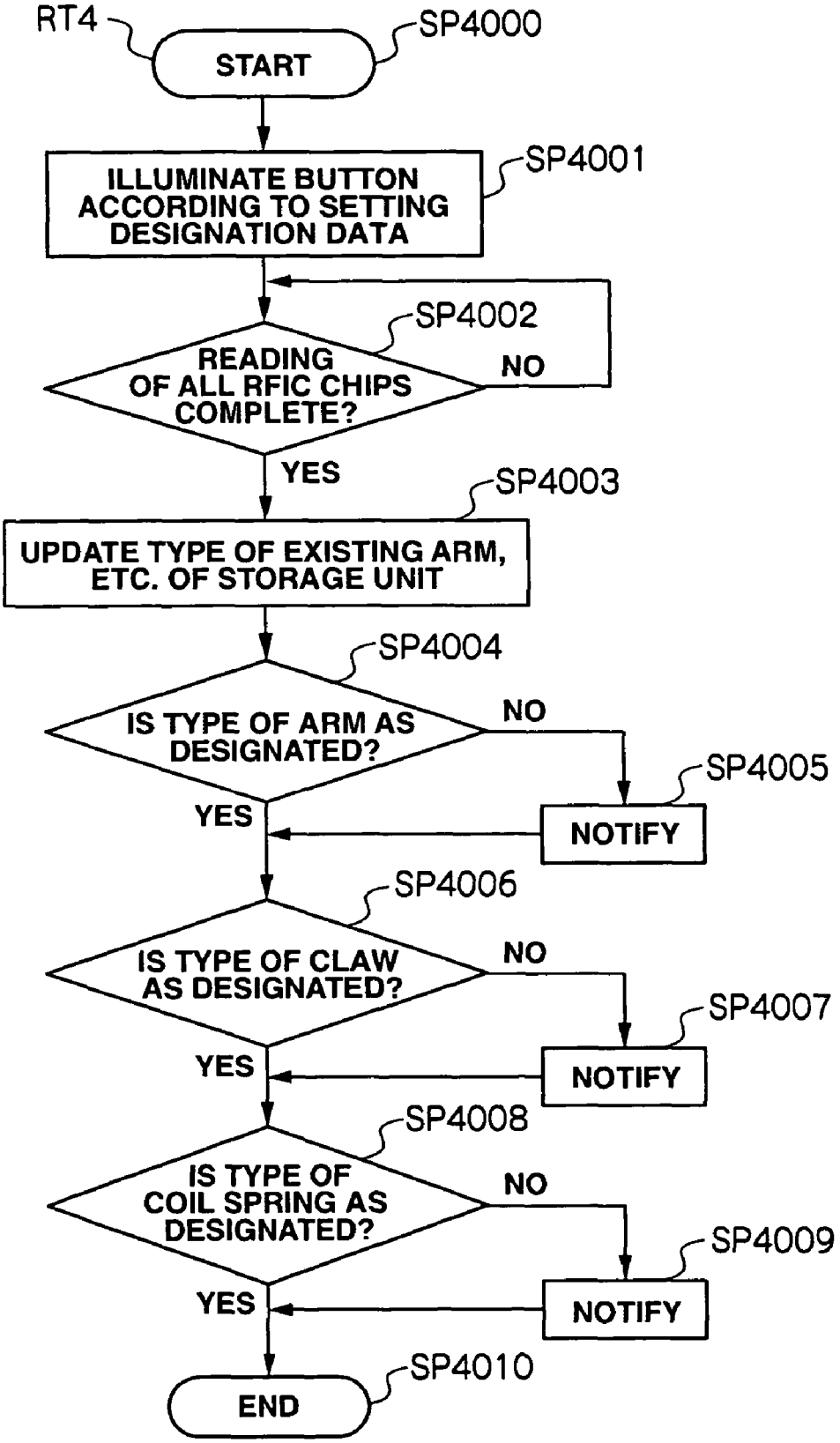
FIG. 17 is a flowchart showing the parts exchange assistance processing routine.

FIG. 17 shows the control processing routine of the control unit 30 of the prize acquisition game apparatus 1 during the series of parts exchange operation. In other words, when the switch 48 of the switch panel 47 is switched to the setting designation display mode after the control unit 30 receives the transmission of the foregoing setting designation data D4 from the management terminal apparatus 41, the control unit 30 starts this parts exchange assistance processing routine RT4 at step SP4000, and, at subsequent step SP4001, reads the setting designation data D4 from the management terminal apparatus 41 stored in the storage unit 13, and illuminates the illumination lamps 49 corresponding to the designated types regarding the respective columns of arm 12, claw 13 and coil spring 28 of the switch panel 47 based on this setting designation data D4.

Next, the control unit 30 proceeds to step SP4002, and waits for the RFID reader 46 to read, after the exchange operation of the required parts (arm 12, claw 13 and/or coil spring 28) is complete, the parts category information and parts type information from all RFID chips 45 respectively mounted on each arm 12, claw 13 and coil spring 28 by the administrator.

And, when the control unit 30 eventually obtains a positive result at step SP4002, it proceeds to step SP4003, and updates the respective types of arm 12, claw 13 and coil spring 28 mounted on the catching unit 5 stored in the storage unit 31 up to such time to the respective types of arm 12, claw 13 and coil spring 28 recognized based on the reading results provided by the RFID reader 46 at such time.

Next, the control unit 30 proceeds to step SP4004, and determines whether the type of arm 12 mounted on the catching unit 5 coincides with the type of designated arm 12 recognized based on the setting designation data D2 from the management terminal apparatus 41. And, when the control unit 30 obtains a positive result at step SP4004, it proceeds to step SP4006, and, when the control unit 30 obtains a negative result, it proceeds to step SP4005 to notify the administrator of the prize acquisition game apparatus 1 to the effect that it obtained a negative result by illuminating a warning lamp not shown or outputting a warning alarm, and thereafter proceeds to step SP4006.

Further, when the control unit 30 proceeds to step SP4006, it determines whether the type of claw 13 currently mounted on the catching unit 5 coincides with the type of designated claw 13 recognized based on the setting designation data D4 from the management terminal apparatus 41. And, when the control unit 30 obtains a positive result at step SP4006, it proceeds to step SP4008, and, when the control unit 30 obtains a negative result, it proceeds to step SP4007 to notify the administrator of the prize acquisition game apparatus 1 to the effect that it obtained a negative result by illuminating a warning lamp or outputting a warning alarm, and thereafter proceeds to step SP4008.

Moreover, when the control unit 30 proceeds to step SP4008, it determines whether the type of coil spring 28 currently mounted on the catching unit 5 coincides with the type of designated coil spring 28 recognized based on the setting designation data D4 from the management terminal apparatus 41. And, when the control unit 30 obtains a positive result at step SP4008, it proceeds to step SP4010 and ends this parts exchange assistance processing routine RT4, and, when the control unit 30 obtains a negative result, it proceeds to step SP4009 to notify the administrator of the prize acquisition game apparatus 1 to the effect that it obtained a negative result by illuminating a warning lamp or outputting a warning alarm, and thereafter proceeds to step SP4010 and ends this parts exchange assistance processing routine RT4.

(1-3) Operation and Effect of Present Embodiment

In the foregoing configuration, the prize acquisition game apparatus 1 stores the type of arm 12, claw 13 and coil spring 28 mounted on the catching unit 5 at such time, and the type of prize 4 (prize category code) read by the RFID reader 46, and transmits such information together with other setting information and payout flags as the log data D1 to the information processing server 41 each time a game is over.

Further, the information processing server 42 calculates the payout ratio per group based on the log data D1 transmitted from the respective prize acquisition game apparatuses 1 with the "cabinet identifying code", "prize identifying code" and "setting status" as the same log data D1 of a single group, and registers such information as the search data D2 in the search database 43A of the database server 43.

Further, when the information processing server 42 is thereafter provided with a search request designating the type of prize 4 and payout ratio from the management terminal apparatus 41, it searches the search database 43A based on such search criterion (type of prize 4 and payout ratio), and transmits to the management terminal apparatus 41 information of the setting status of the search data D2 coinciding with the designated search criterion. Moreover, the management terminal apparatus 41, according to the operator's operation, transmits to the designated prize acquisition game apparatus 1 this setting status or information on the arranged setting status as the setting designation data D4.

And, the prize acquisition game apparatus 1 that received this setting designation data D4, based on this setting designation data D4, determines whether the respective types of arm 12, claw 13 and coil spring 28 mounted on the catching unit 5 at such time correspond with the respectively designated types based on the setting designation data D4, and, when these do not coincide, it notifies this to the administrator of the prize acquisition game apparatus 1, and visually displays the type of designated arm 12 and the like.

Accordingly, with this game apparatus operating system 40, since it is possible to immediately select and decide the optimum arm 12, claw 13 and coil spring 28 based on the past experience as the arm 12, claw 13 and coil spring 28 of the prize acquisition game apparatus 1 corresponding to the prize 4, the optimum arm 12, claw 13 and coil spring 28 can be set without having to depend on the experience of the administrator of the prize acquisition game apparatus 1. Furthermore, according to the present invention, even when handling the same prize under temporally (date and time) and spatially (location) different circumstances, an index for performing the optimum operation can be obtained. Moreover, when introducing a new prize 4 with no past records, by referring to the records of a prize 4 with of a similar nature, an effect is yielded in that an index for performing the optimum operation can be obtained.

Further, with the game apparatus operating system 40, since the type of designated arm 12, claw 13 and coil spring 28 recognized based on the setting designation data D4 is visually displayed in the prize acquisition game apparatus 1, the adjustment operation of game difficulty of the prize acquisition game apparatus 1 can be facilitated without requiring the confirmation procedure by the administrator regarding the current arm 12 and the like in the prize acquisition game apparatus 1.

According to the foregoing configuration, each time a game is over, the log data D1 composed from the type of arm 12, claw 13 and coil spring 28 mounted on the catching unit 5 and payout flags or the like is transmitted from the respective prize acquisition game apparatuses 1 to the information processing server 41, a search data D1 that calculated the payout ratio per group based on this log data D1 is created with the "cabinet identifying code", "prize identifying code" and "setting status" as the same log data D1 of a single group, and this is registered in the search database 43A on the one hand, and, by designating the type of prize 4 and payout ratio with the search database 34A, the type of optimum arm 12, claw 13 and coil spring 28 to be set in the prize acquisition game apparatus 1 can be searched, the setting status of difficulty of the prize acquisition game apparatus 1 optimum to the desired prize 4 can be easily and reliably detected, and, as a result, a game apparatus operating system capable of promoting the efficiency in operating the prize acquisition game apparatus 1 can be realized.

Further, since the foregoing search result is transmitted to the desired prize acquisition game apparatus 1 and the type of designated arm 12, claw 13 and coil spring 28 recognized based on such search result is visually displayed in the prize acquisition game apparatus 1, the adjustment operation of game difficulty of the prize acquisition game apparatus 1 can be facilitated without requiring the confirmation procedure by the administrator regarding the current setting status of the prize acquisition game apparatus 1, and, as a result, a prize acquisition game apparatus capable of alleviating the burden of the difficulty adjustment operation can be realized.

Figure 18:
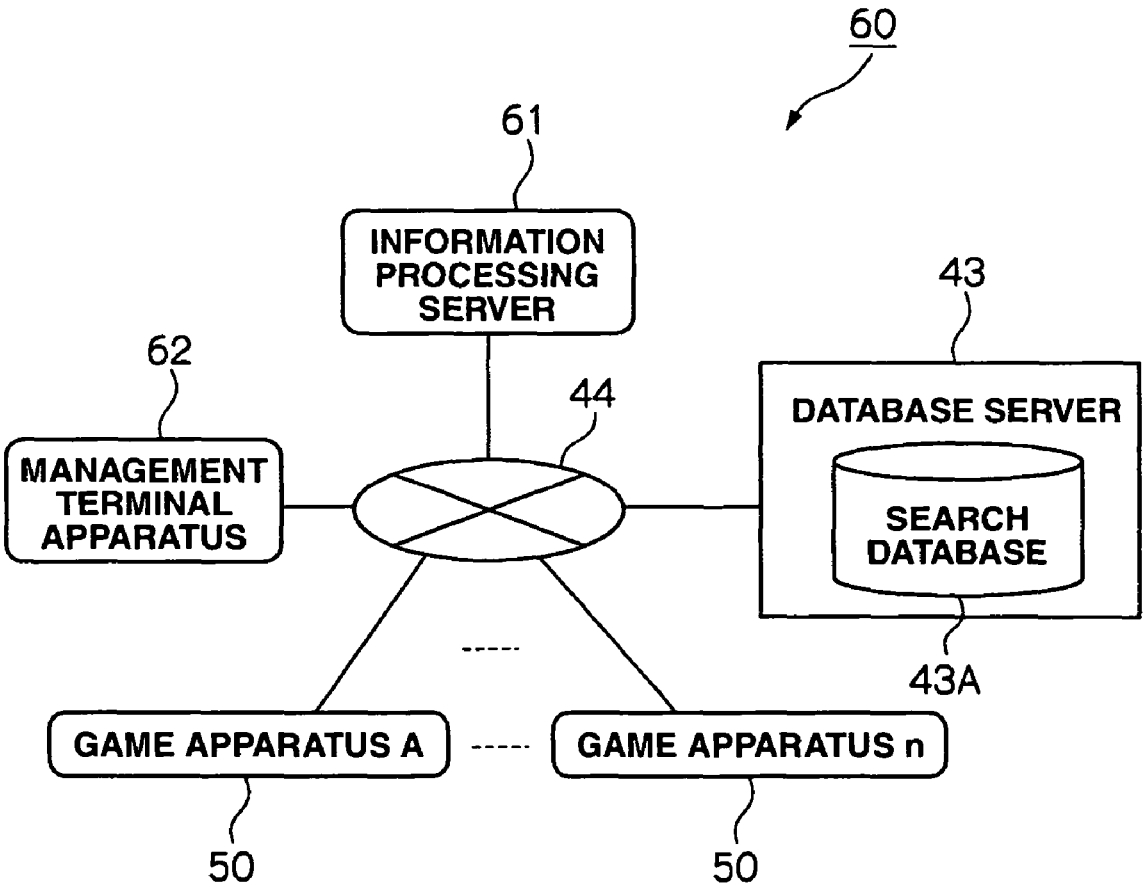
FIG. 18 is a block diagram showing the game apparatus operating system according to the second embodiment.

(2) Second Embodiment (2-1) Configuration of Game Apparatus Operating System in Second Embodiment FIG. 18 shows. a game apparatus operating system 60 according to the second embodiment, and is configured the same as the game apparatus operating system 40 (FIG. 9) according to the first embodiment other than the point that the respective prize acquisition game apparatuses 50 are able to automatically recognize the respective types of arm 12, claw 13 and coil spring 28 mounted on the catching unit 5, and the point that method of creating the search data in the information processing server 61 is different.

In actuality, in the case of this game apparatus operating system 60, as the unit for the prize acquisition game apparatus 51 to automatically recognize the type of arm 12, claw 13 and coil spring 28 of the spring unit 22 mounted on the catching unit 5, as in the first embodiment, an RFID chip 45 (FIG. 10) recording parts category information representing the category of parts (arm 12, claw 13 or coil spring 28) and parts type information representing the type of parts ("large, medium, small, other" or "strong, medium, weak") is mounted on all types of arm 12, claw 13 and coil spring 28 to be mounted on the catching unit 5 of the prize acquisition game apparatus 51.

Figure 19:
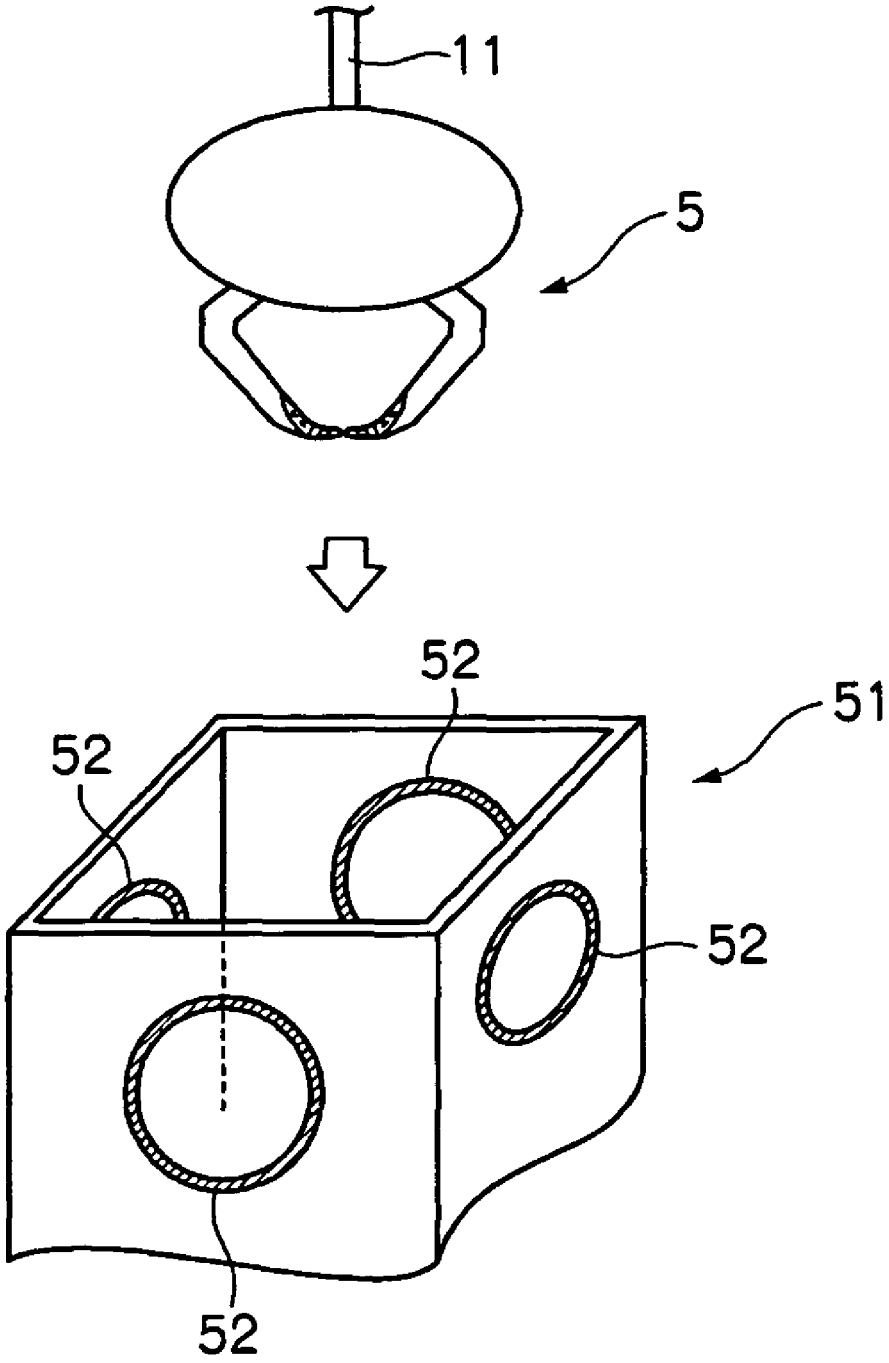
FIG. 19 is a schematic perspective view showing the configuration of the prize drop-in guide in the prize acquisition game apparatus according to the second embodiment.
Figure 20:
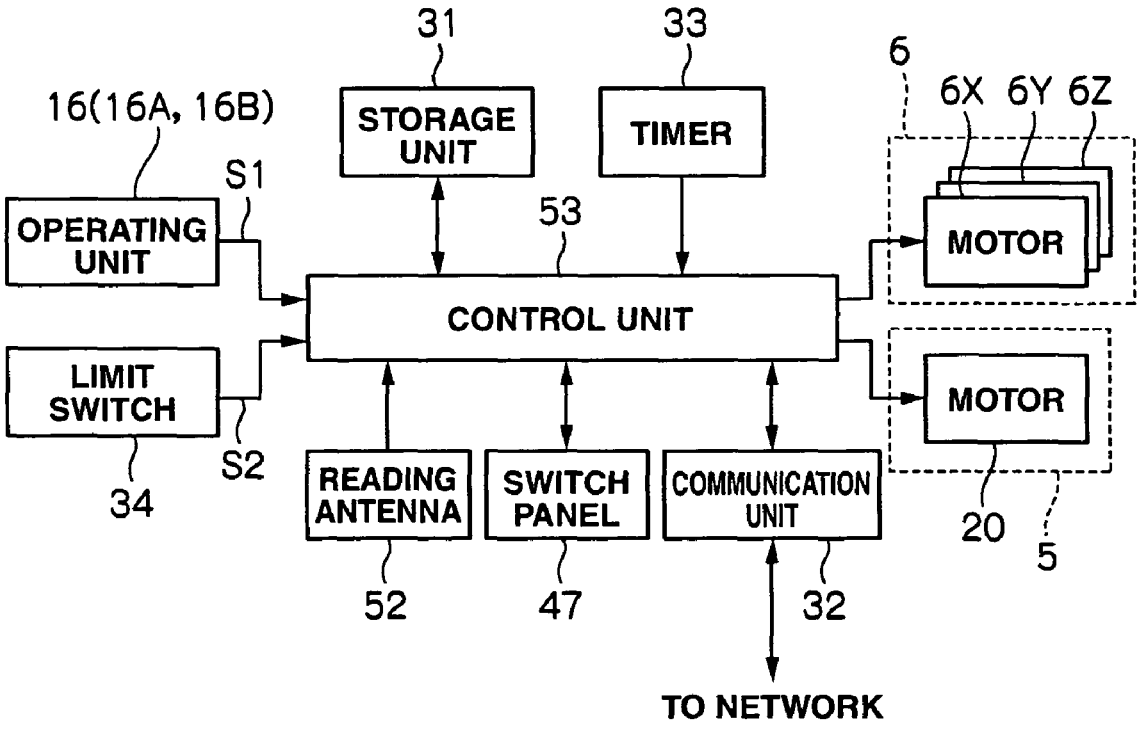
FIG. 20 is a block diagram showing the internal configuration of the prize acquisition game apparatus according to the second embodiment.

Further, as shown in FIG. 19, reading antennae 52 are respectively provided to two faces in the lateral direction and two faces in the longitudinal direction of the prize drop-in guide 51 in the housing of the respective prize acquisition game apparatuses 50. Moreover, as shown in FIG. 20 having the same numerals for components corresponding to those shown in FIG. 7, these reading antennae 52 are connected to the control unit 53 for controlling the overall operation of the prize acquisition game apparatus 50, and, as a result, the control unit 53 is capable of communication with the RFID chip 45 (FIG. 10) respectively mounted on the arm 12, claw 13 or coil spring 28 via these reading antennae 52.

Figure 21:
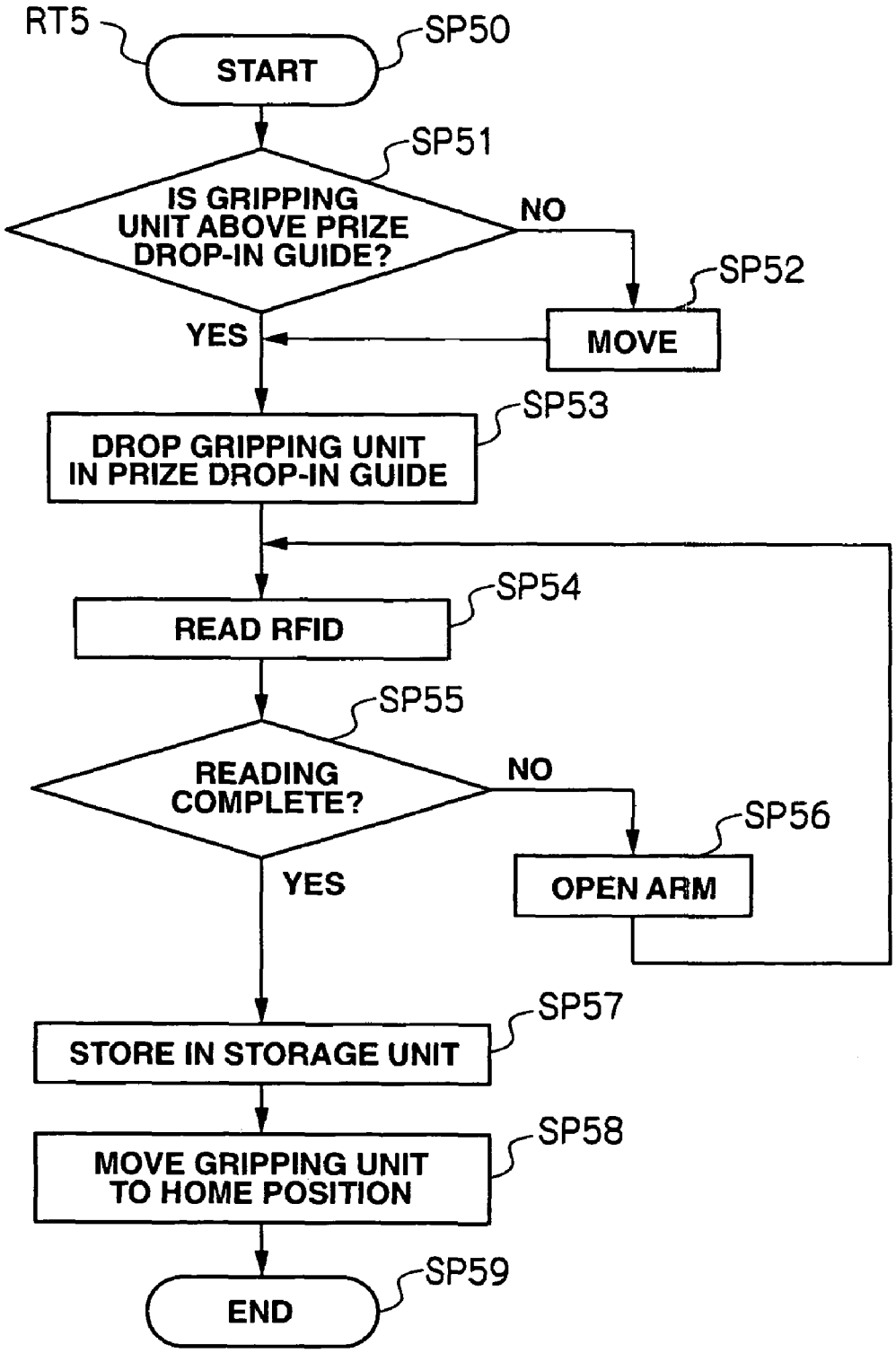
FIG. 21 is a flowchart showing the arm-type automatic recognition processing routine.

As a result, the control unit 53, according to the arm-type automatic recognition processing routine RT5 shown in FIG. 21, moves the catching unit 5 inside the prize drop-in guide 51, reads the parts category information and parts type information recorded on the respective RFID chips 45 mounted on each arm 12, claw 13 and coil spring 28 via the reading antenna 52, and is thereby able to automatically recognize the respective types of arm 12, claw 13 and coil spring 28 mounted on the catching unit 5 at such time.

In other words, when the control unit 53 starts the arm-type automatic recognition processing routine RT5 at step SP50 in a predetermined timing, at subsequent step SP51, it determines whether the catching unit 5 is positioned above the prize drop-in guide 51. Specifically, with the prize acquisition game apparatus 50 according to this embodiment, since the home position is set immediately above the prize drop-in guide 51, the determination will be whether the catching unit 5 is positioned at the home position. Nevertheless, if the home position is not set immediately above the prize drop-in guide 51, determination will be whether the catching unit 5 is positioned immediately above the prize drop-in guide 51.

And, when the control unit 53 obtains a positive result at step SP51, it proceeds to step SP53, and, when the control unit 53 obtains a negative result, it proceeds to step SP52 to operate the X direction motor 6X (FIG. 20), Y direction motor 6Y (FIG. 20) and Z direction motor 6Z (FIG. 20) of the moving part 6 so as to move the catching unit 5 above the prize drop-in guide 51, and thereafter proceeds to step SP53.

And, when the control unit 53 proceeds to step SP53, it operates the Z direction motor 6Z of the moving part 6 so as to lower the catching unit 5 and move such catching unit 5 inside the prize drop-in guide 51, and thereafter proceeds to step SP54 to read the parts category information and parts type information recorded in the RDIF chips 45 by communication with the RFID chips 45 respectively mounted on the arm 12, claw 13 and coil spring 28 via the reading antenna 52. And, the control unit 53 respectively recognizes the type of arm 12, claw 13 and coil spring 28 based on the parts category information and parts type information read from the respective RFID chips 45.

Thereafter, the control unit 53 proceeds to step SP55 and determines whether the parts category information and parts type information from all RFID chips 45 mounted on each arm 12, claw 13 and coil spring 28 have been read, and, upon obtaining a negative result, it proceeds to step SP56 and operates the motor 20 (FIG. 20) of the catching unit 5 to release the arm 12 so as to improve the reading accuracy of the parts category information and parts type information from the respective RFID chips 45.

Incidentally, the catching unit 5 may be repeatedly raised and lowered, or the arm 12 may be repeatedly opened and closed so as to improve the reading accuracy of the parts category information and parts type information from the respective RFID chips 45. Further, the raising and lowering of the catching unit 5 and the opening and closing of the arm 12 may be combined; in other words, only the catching unit 5 may be raised and lowered to read the parts category information and parts type information from the respective RFID chips 45, and, if such reading is not possible, the arm 12 may be repeatedly opened and closed while raising and lowering the catching unit 5.

Next, the control unit 53 returns to step SP54, and thereafter repeats in a loop the steps SP55-SP56-SP54-SP55 until it obtains a positive result at step SP55. And, when the control unit 53 eventually obtains a positive result at step SP55, it proceeds to step SP57, and stores the respective types of arm 12, claw 13 and coil spring 28 recognized as described above in the storage unit 31.

Further, the control unit 53 thereafter proceeds to step SP58 and operates the motor 20 of the catching unit 5 so as to close the arm 12, and operates the Z direction motor 6Z of the moving part 6 so as to move the catching unit 5 to the home position, and thereafter proceeds to step SP59 and ends the arm-type automatic recognition processing routine RT5.

Figure 22:
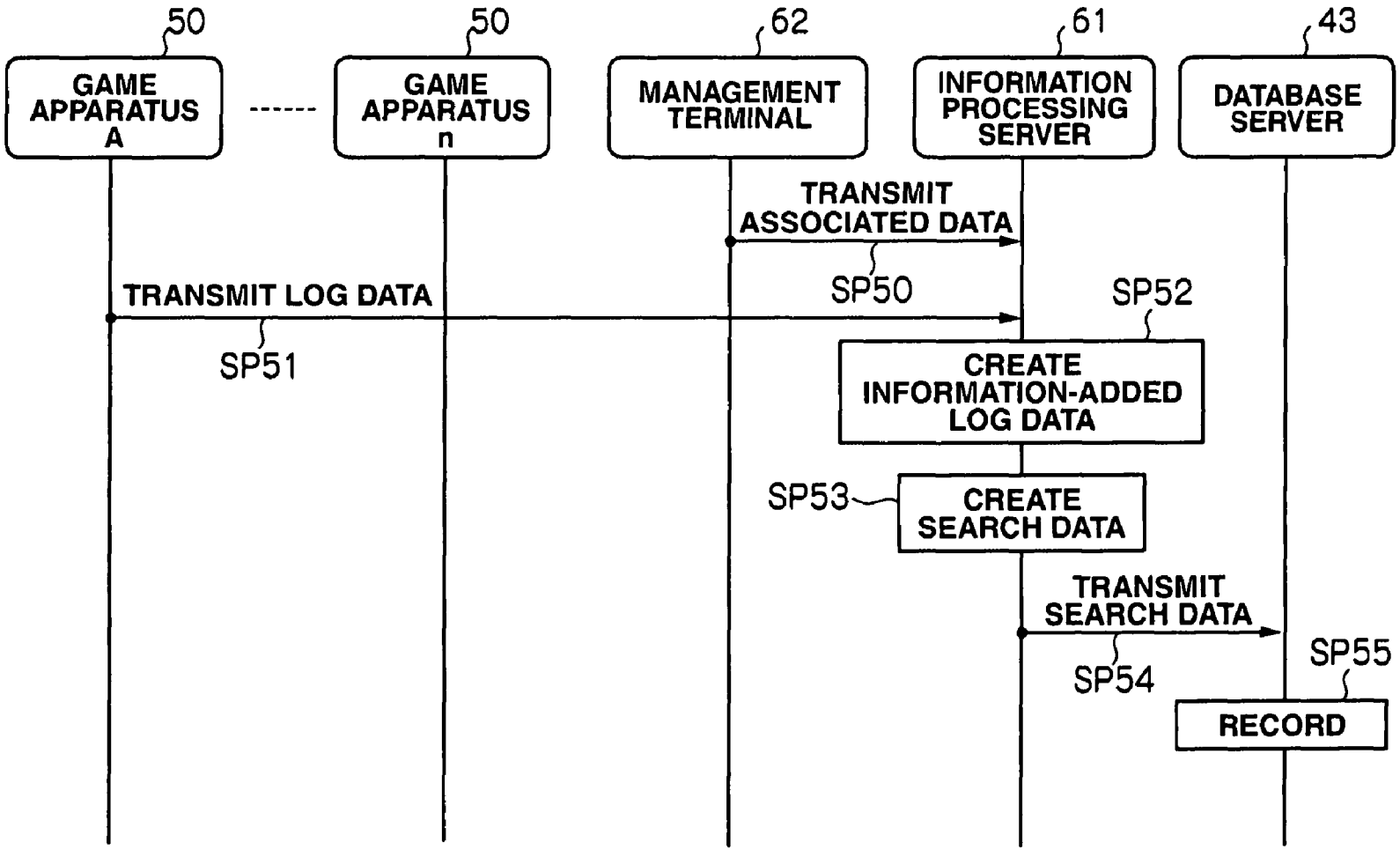
FIG. 22 is a timing chart for explaining the operation up to the creation of the search database in the game apparatus operating system according to the second embodiment.

Meanwhile, the control unit 53, as shown in FIG. 22, each time a game is over, creates a log data D11 composed from various types of information including "time", "cabinet identifying code", "setting status" and "payout flag" as shown in FIG. 23(B), and transmits this to the information processing server 61 (SP51). This log data D11, as evident when comparing FIG. 14 and FIG. 23, has the same configuration as the log data D1 in the first embodiment excluding the point that the information of "prize identifying code" is not included therein.

Here, an associated data D10 as shown in FIG. 23(A) is transmitted beforehand from the management terminal apparatus 62 to the information processing server 61 (SP50). This associated data D10 is created based on the cabinet identifying code per prize acquisition game apparatus 50 input beforehand by the operator of an operating company via an input unit such as a keyboard or mouse provided to the management terminal apparatus 62, and a prize type code showing the type of prizes 4 respectively housed in each prize acquisition game apparatus 50.

And, the information processing server 61 creates an information-added log data D12 having the same configuration as the log data D1 described above in which a "prize type code" has been added to this log data D11 as shown in FIG. 23(C) based on the associated data D10 transmitted from the management terminal apparatus 62, and the log data D11 transmitted from each prize acquisition game apparatus 50 (SP52). Then, the information processing server 61 thereafter creates a search data D13 shown in FIG. 23(D) as with the first embodiment based on the information-added log data D12 created above (SP53), transmits this to the database server 43 (SP54), and records this in the search database 43A (SP55).

Like this, this game apparatus operating system 60 is capable of creating a search data D12 based on the respective recognition results of the type of arm 12, claw 13 and coil spring 28 mounted on the catching unit 5 automatically recognized in each prize acquisition game apparatus 50, and thereafter searching the various setting statuses for paying out the designated prize 4 at the designated payout ratio based on the search data D12.

(2-2) Operation and Effect of Present Embodiment

In the foregoing configuration, with this game apparatus operating system 60, the catching unit 5 is moved inside the prize drop-in guide 51 in a prescribed timing in the prize acquisition game apparatus 50, and the respective types of arm 12, claw 13 and coil spring 28 mounted on the catching unit 5 are automatically recognized with the reading antennae 52 mounted on the prize drop-in guide 51.

Accordingly, with this game apparatus operating system 60, the respective types of the current arm 12, claw 13 and coil spring 28 in the prize acquisition game apparatus 50 can be detected without any manual labor, and, therefore, the game difficulty of the prize acquisition game apparatus 50 can be adjusted more easily in comparison to the game operating system 40 according to the first embodiment.

According to the foregoing configuration, since it is possible to automatically recognize the various types of the current arm 12, claw 13 and coil spring 28 in the prize acquisition game apparatus 50, the game difficulty of the prize acquisition game apparatus can be adjusted more easily, and, as a result, a prize acquisition game apparatus capable of alleviating the burden of the difficulty adjustment operation can be realized.

(3) Third Embodiment

(3-1) Configuration of Prize Acquisition Game Apparatus in Third Embodiment

Reference numeral 70 in FIG. 1 represents the prize acquisition game apparatus 70 according to the third embodiment which applies the game apparatus operating system 60 described with reference to FIG. 18 in substitute for the prize acquisition game apparatus 50 according to the second embodiment. The prize acquisition game apparatus 70 according to this third embodiment has the same configuration as the prize acquisition game apparatus 50 according to the second embodiment excluding the point that the automatic recognition method for automatically recognizing the type of arm 12 and claw 13 mounted on the catching unit 5 is different.

Figure 24:
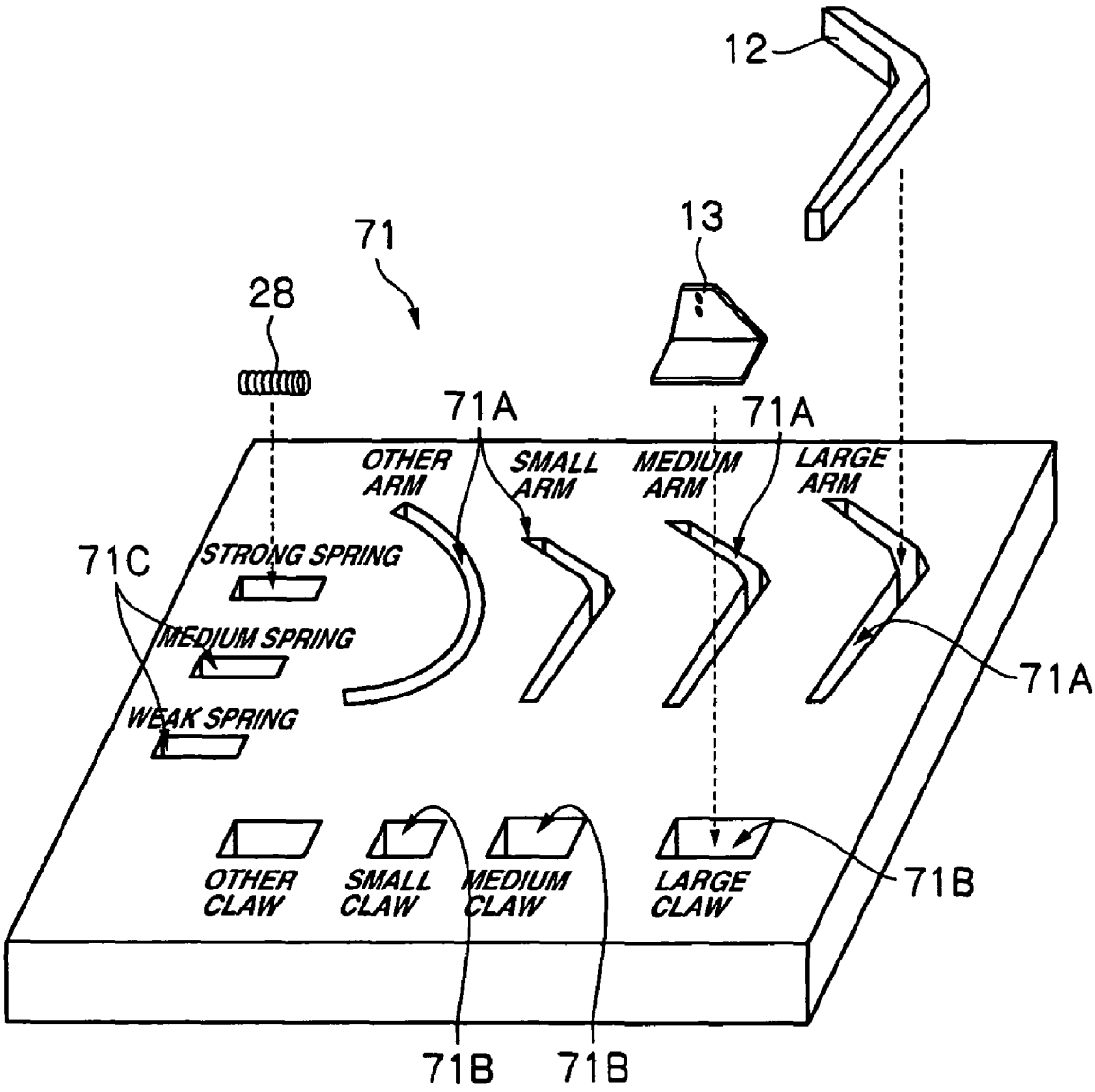
FIG. 24 is a perspective view showing the configuration of the housing case.

In other words, in the case of this prize acquisition game apparatus 70, a housing case 71 as shown in FIG. 24 is disposed inside the opening-closing door 19. This housing case 71 has concave portions 71A, 71B in the same shape and size as the respective types of arms 12 and claws 13 in correspondence with the large, medium, small and other types of arms 12 and claws 13, and concave portions 71C in the same shape and size as the coil springs in correspondence with the strong, medium and weak coil springs 28, and the corresponding types of arm 12, claw 13 or coil spring 28 are fitted into the respective concave portions 71A, 71B, 71C in advance.

Figure 25:
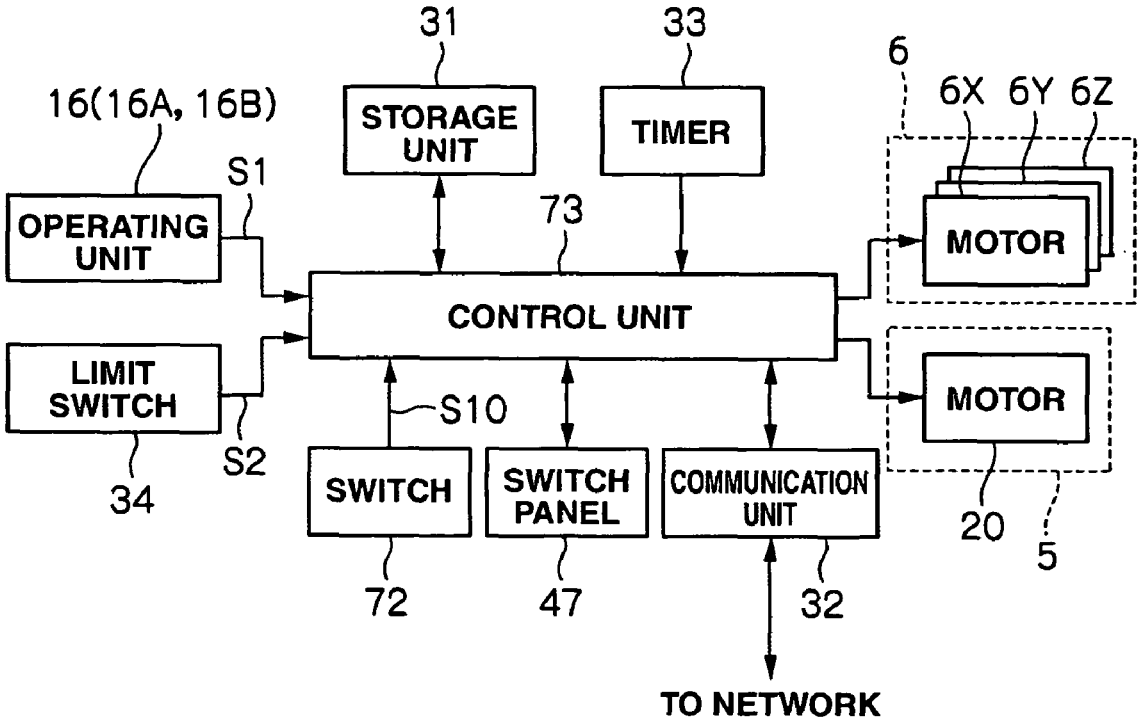
FIG. 25 is a block diagram showing the internal configuration of the prize acquisition game apparatus according to the third embodiment.

Further, for instance, a switch 72 (FIG. 25) for detecting the existence of the corresponding arm 12, claw 13 or coil spring 28 in the respective concave portions 71A, 71B, 71C is provided to the bottom face position of each concave portion 71A, 71B, 71C of the housing case 71. And, these switches 72 detect the pressure upon the corresponding types of arm 12, claw 13 or coil spring 28 being respectively fitted in each concave portion 71A, 71B, 71C, and, as shown in FIG. 25 having the same reference numerals as the components corresponding to those of FIG. 19, this detection result is transmitted as a pressure detection signal S10 to the control unit 73 for controlling the overall operation of the prize acquisition game apparatus 70.

Further, the control unit 73, based on the pressure detection signal S10 provided from the respective switches 72, specifies the respective types of arm 12, claw 13 and coil spring 28 not existing in the housing case 71; that is, the type of arm 12, claw 13 and coil spring 28 removed from the housing unit 71 and mounted on the catching unit 5 at such time, and stores the respective types of the specified arm 12, claw 13 and coil spring 28 in the storage unit 31.

Like this, with this prize acquisition game apparatus 70, without having to respectively mount the RFID on the respective types of arm 12, claw 13 and coil spring 28, the control unit 53 will be able to easily recognize the type of arm 12, claw 13 and coil spring 28 mounted on the catching unit 5 at such time.

According to the foregoing configuration, since a housing for individually housing the respective types of arm 12, claw 13 and coil spring 28 is provided, a switch 72 for detecting whether such arm 12, claw 13 or coil spring 28 exists in the housing case 71 is provided at the housing position of the respective types of arm 12, claw 13 and coil spring 28 in the housing case 71, and the type of arm 12, claw 13 or coil spring 28 mounted on the catching unit 5 at such time is specified based on the pressure detection signal S10 respectively output from the switches 72, in addition to the effect yielded by the prize acquisition game apparatus 50 according to the second embodiment, a prize acquisition game apparatus that can be constructed less expensively than the prize acquisition game apparatus 50 can be realized.

(4) Other Embodiments

Incidentally, in the foregoing first to third embodiments, although a case was explained where the management terminal apparatus 41, 62 was used to search the status to be set in the prize acquisition game apparatus 1, 50, 70 with the prize identifying code of the desired prize 4 and the desired payout ratio as the keywords, the present invention is not limited thereto, and the status to be set in the prize acquisition game apparatus 1, 50, 70 may be searched based on other items as the keywords.

Further, in the foregoing first to third embodiments, although a case was explained regarding the application of the present invention in a one-person prize acquisition game apparatus 1 provided with only one pair of catching unit 5 and operating unit (first and second operation switches 16A, 16B) for the player to perform movement operations as shown in FIG. 1, the present invention is not limited thereto, and, for instance, this may be applied to multi-person prize acquisition game apparatus provided with a plurality of pairs of catching units 5 and operating units. Here, since it is necessary to include setting status information per catching unit in the log data D1, D11 to be transmitted from the prize acquisition game apparatus to the information processing server 40, 61, for example, an identifying code per catching unit for distinguishing which setting status is for which catching unit may be added immediately before each setting status information.

Moreover, in the foregoing first to third embodiments, although a case was explained where the switch panel 47 described with reference to FIG. 12 was applied as the notification unit for notifying the respective types of arm 12, claw 13 and coil spring 28 to be mounted on the catching unit 5 recognized based on the setting designation data D4 to be transmitted from the management terminal apparatus 41, 62 to the prize acquisition game apparatus 1, 50, 70, the present invention is not limited thereto, and, for instance, such notification may be made with a sound output unit such as a speaker for outputting sounds, or another display unit such as a liquid crystal panel or the like other than the switch panel 47 may also be used.

In addition, in the foregoing first to third embodiments, although a case was explained where the respective types of arm 12, claw 13 and coil spring 28 to be mounted on the catching unit 5 are transmitted and designated from the management terminal apparatus 41, 62, the present invention is not limited thereto, and, for instance, such designation may be made by mounting, on the tag of the prize 4, an information recording medium such as an RFID chip or barcode recording "prize identifying information" for identifying the type of prize and "parts type information" of the arm 12, claw 13 and coil spring 28 to be mounted on the catching unit 5.

Here, the control unit (control unit 30, 53, 73) is controlled so that the "parts type information" of the arm 12, claw 13 and coil spring 28 recorded in the information recording medium is detected with an information reading unit such as the RFID reader 46 in the prize acquisition game apparatus 1, 50, 70, and the respective types of arm 12, claw 13 and coil spring 28 to be mounted on the catching unit 5 are notified with the notification unit such as the switch panel 47 based on the read results. Further, after the administrator of the prize acquisition game apparatus 1, 50, 70 thereafter exchanges the arm 12, claw 13 and/or coil spring 28, the control unit detects the respective types of arm 12, claw 13 and coil spring 28 mounted on the catching unit 5 at such time with some kind of detection unit, determines the match or mismatch of the foregoing detection result and the respective types of arm 12, claw 13 and coil spring 28 mounted on the catching unit 5, and causes the notification unit to make a notification to such effect. And, by constructing this kind of prize acquisition game apparatus 1, 50, 70, at a stage where a certain degree of know-how is accumulated, the respective types of optimum arm 12, claw 13 and coil spring 28 per prize 4 can be designated to the administrator of the prize acquisition game apparatus 1, 50, 70 without having to go through the information processing server 42.

Further, "payout information" representing the payout ratio may be recorded in the information recording medium to be mounted on the tag of the prize 4. For example, a plurality of combinations of the "payout information" and the "parts type information" of the arm 12, claw 13 and coil spring 28 to be mounted on the catching unit 5 for setting the payout ratio representing such payout information (for instance, type of arm 12 and the like at a payout ratio of 10%, type of arm 12 and the like at a payout ratio of 20%, type of arm 12 and the like at a payout ratio of 30% . . . ) are recorded in the information recording medium, and a setting input unit such as a dial for inputting the setting of the desired payout ratio is provided to the prize acquisition game apparatus 1, 50, 70. And, the information reading unit will read the combined information of the "payout information" and "parts type information" recorded in the information recording medium, and the notification unit will notify such information (for instance, display type of arm 12 and the like at a payout ratio of 10%, type of arm 12 and the like at a payout ratio of 20% . . . ). And, after the administrator exchanges the arm 12 and the like based on the notified information, the foregoing control unit determines whether the payout ratio and type of arm 12 and the like after the operation detected with some kind of detection unit coincides with the type of arm 12 and the like for obtaining the payout ratio set by the administrator with the foregoing setting unit based on the combination information of the "payout information" and "parts type information" recorded in the foregoing information recording medium, and, if these do not coincide, causes the notification unit to make such notification. Incidentally, when the foregoing setting unit is not to be provided to the prize acquisition game apparatus 1, 50, 70, the "parts type information" representing the type of optimum arm 12 and the like per one payout ratio is recorded in the information recording medium, and the match or mismatch of only the arm 12 and the like may be determined, and the notification unit may make such notification only in the case of a mismatch.

Further, in the foregoing first to third embodiments, although a case was explained where the search database 43A for searching the respective types of the appropriate arm 12, claw 13 and coil spring 28 for the prize 4 was included to be in the database server 43, the present invention is not limited thereto, and, for instance, by periodically transmitting a part or all of the data of the search database 43A from the database server 43 to the respective prize acquisition game apparatuses 1, 50, 70, a database for searching the type of arm 12, claw 13 and coil spring 28 capable of obtaining a desired payout ratio in relation to the type of prize 4 may be stored beforehand in the storage unit 31 of the respective prize acquisition game apparatuses 1, 50, 70.

Here, an input unit such as a dial for inputting the setting of the desired payout ratio is provided to the prize acquisition game apparatus 1, 50, 70, and, when the "prize identifying information" showing the type of prize such as the prize category code of the prize 4 attached to the prize 4 is read by an information reading unit such as the RFID reader 46, the control unit 30, 53, 73 searches the type of arm 12, claw 13 and coil spring 28 for paying out the prize 4 at the set "payout ratio" from the database stored in the storage unit 31 with the "prize identifying information" and the "payout ratio" set by the administrator via the setting input unit as the search criterion, and the type of arm 12 and the like mounted on the catching unit 5 at such time is detected with some kind of detection unit, and, when the type of arm 12 and the like mounted on the catching unit 5 does not coincide with the type of ideal arm 12 searched above, this may be notified with a notification unit such as a switch panel 47 or other display unit or a sound output unit such as a speaker.

In the foregoing case, after notifying the type of appropriate arm 12, claw 13 and coil spring 28, if the administrator of the prize acquisition game apparatus 1, 50, 70 exchanges the arm 12, claw 13 and/or coil spring 28, the type of arm and claw 13 mounted on the catching unit 5 at such time is detected with some kind of detection unit, the type of detected arm 12 and claw 13 is compared with the type of notified arm 12 and claw 13, and, when these do not coincide, the notification unit makes a notification to such effect.

Further, in the foregoing first embodiment, although a case was explained where the RFID chip 45 recording the parts category information and parts type information of all types of arm 12, claw 13 and coil spring 28 was mounted as the unit for enabling the prize acquisition game apparatus 1 to semi-automatically recognize the respective types of arm 12, claw 13 and coil spring 28 mounted on the catching unit 5 of the prize acquisition game apparatus 1 and the type of prize 4, the present invention is not limited thereto, and a barcode may be mounted in substitute for the RFID chip 45 to the arm 12, claw 13, coil spring 28 and respective prizes 4, and a barcode reader may be provided to the prize acquisition game apparatus 50 instead of the RFID reader 46. Further, other items other than a barcode or barcode reader may be widely used so as long as they are able to read the type of arm 12 and the like in a contact or non-contact manner.

Further, in the foregoing second embodiment, although a case was explained where a reading antenna 52 was disposed in the prize drop-in guide 51 of the prize acquisition game apparatus 50, the present invention is not limited thereto, and, for instance, a reading antenna may be disposed inside the catching unit 5, and the control unit 53 may read the parts category information and parts type information from the RFID chip 45 mounted on the arm 12 and the like via this reading antenna.

Further, for example, when disposing an IC chip recording parts category information and parts type information in the arm 12 and claw 13, and mounting these arms arm 12 on the catching unit 5 or mounting the claw 13 on the arm 12, the IC chip and control unit 53 will be electrically connected with a signal line, and the control unit 53 may read the parts category information and parts type information from the IC chip via such signal line.

Further, in the foregoing second embodiment, although a case was explained where the prize acquisition game apparatus 50 directly transmitted the log data D10 to the information processing server 42, the present invention is not limited thereto, and the log data D1 may be transmitted to the information processing server 42 through the management terminal apparatus 41.

Further, in the foregoing third embodiment, although a case was explained where a switch 72 was applied as the detection unit for detecting whether the parts (arm 12, claw 13 or coil spring 28) corresponding to the respective concave portions 71A to 71C are housed in the housing case 71, the present invention is not limited thereto, and, for instance, a piezoelectric element or the like may be widely used as such detection unit.

The present invention can be particularly employed in a crane-type prize acquisition game apparatus and an operating system thereof.

What is claimed is:

1. A prize acquisition game apparatus, comprising:

a housing configured to provide a closed space in which prizes are arranged;

a console provided outside of said closed space with switches operable by a player who tries to get one of the prizes;

a catching unit arranged movably inside said closed space in responding to an external operation on the console by the player, said catching unit being provided with a first driving mechanism and a set of movable catching arms, opening and closing movement of said catching arms being driven by said first driving mechanism, said catching arms being configured removably and exchangeably mountable against the first driving mechanism of said catching unit, each of said catching arms being provided with claws each configured exchangeably mountable to a tip of the corresponding catching arm, said catching arms and said claws being configured to allow a maintenance operator for the apparatus to removably and exchangeably mount them by selecting a set of said catching arms and/or a set of said claws from a storage in which exchangeable members including plural sets of alternative catching arms and claws are provided differently from one another at least in sizes;

an input unit configured to input configuration data including information indicative of the respective types of said catching arms and/or said claws mounted on said catching unit;

a second driving mechanism configured to movably support said catching unit in said closed space so as to enable said catching unit to move in X, Y, and vertical directions in responding to an operation on said switches by the player; and a control unit arranged to control said first driving mechanism in accordance with the configuration data including data associating said arm type and/or said claw type so as to control the movement of said catching arms to provide a certain spaced distance among said catching arms when said catching arms are opened and to provide a certain catching strength to be applied to a prize by said catching arms and said claws when said catching arms are closed in accordance with the configuration data including the data associating said catching arms and claws selectively mounted to said catching unit.

2. The prize acquisition game apparatus according to claim 1, wherein said catching unit is exchangeably mounted with an elastic body configured to determine a maximum value of the catching strength of said first driving mechanism; and wherein said configuration data includes the type of said elastic body.

3. The prize acquisition game apparatus according to claim 2 wherein said input unit is associated with detection means;

wherein exchangeable members including said alternative arms, claws and elastic body are stored in said storage and respectively configured to carry, detectably by said detection means, information representing types of said arms, said claws or said elastic bodies; and wherein said detection means detects the information from said exchangeable members mounted to said catching unit in a non-contact manner, and the detected information is inputted to said input unit.

4. The prize acquisition game apparatus according to claim 1, wherein said storage is provided with particular places to which corresponding ones of said exchangeable members are placed, each of said places being formed with detection means configured so that, when one of said exchangeable members is removed from the place particular to said exchangeable member and mounted on said catching unit, information indicative of the removed exchangeable member is input to said input unit so as to modify said configuration data.

5. A prize acquisition game apparatus comprising:

a housing configured to provide a closed space in which prizes are arranged;

a console provided outside of said closed space with switches operable by a player who tries to get one of the prizes;

a catching unit arranged movably inside said closed space in responding to an external operation on the console by the player, said catching unit being provided with a set of movable catching arms configured exchangeably mountable to said catching unit, each of said catching arms being provided with claws each configured exchangeably mountable to a tip of the corresponding catching arm, said catching arms and said claws being configured to allow a maintenance operator for the apparatus to removably mount them by selecting a set of said catching arms and/or a set of said claws from a storage in which exchangeable members including plural sets of alternative catching arms and claws are provided differently from one another at least in sizes;

a driving mechanism configured to movably support said catching unit in said closed space so as to enable said catching unit to move in X, Y, and vertical directions in responding to an operation on said switches by the player and configured to cause said catching arms to make open and close movements;

a detection means configured to detect data indicative of an exchangeable member which is selected from said storage and currently mounted on said catching unit, a notification means configured to display an indication indicative of said exchangeable member currently mounted on said catching unit in response to the data detected with said detection means; and a control unit arranged to control said driving mechanism in accordance with configuration data of the said arm type and/or said claw type currently mounted on said catching unit so as to control the movement of said catching arms to provide a certain spaced distance among said catching arms when said catching arms are opened and to provide a certain catching strength to be applied to a prize by said catching arms and said claws when said catching arms are closed in accordance with the configuration data.

6. A prize acquisition game apparatus comprising:

a housing configured to provide a closed space in which prizes are arranged;

a console provided outside of said closed space with switches operable by a player who tries to get one of the prizes;

a catching unit arranged movably inside said closed space in responding to an external operation on the console by the player, said catching unit being provided with a set of movable catching arms configured exchangeably mountable to said catching unit, each of said catching arms being provided with claws each configured exchangeably mountable to a tip of the corresponding catching arm, said catching arms and said claws being configured to allow a maintenance operator for the apparatus to removably mount them by selecting a set of said catching arms and/or a set of said claws from a storage in which exchangeable members including plural sets of alternative catching arms and claws are provided differently from one another at least in sizes;

an input unit configured to input configuration data including information indicative of the respective types of said catching arms and/or said claws currently mounted on said catching unit:

a driving mechanism configured to movably support said catching unit in said closed space so as to enable said catching unit to move in X, Y, and vertical directions in responding to an operation on said switches by the player and configured to cause said catching arms to make open and close movements;

a control unit arranged to control said driving mechanism in accordance with the configuration data associated with said arm type and/or said claw type so as to control the movement of said catching arms to provide a certain spaced distance among said catching arms when said catching arms are opened and to provide a certain catching strength to be applied to a prize by said catching arms and said claws when said catching arms are closed in accordance with the configuration data including the data associating said catching arms and claws selectively mounted to said catching unit; and a notification means configured to indicate exchangeable members appropriate in relation to said prize arranged in said closed space in response to an input of identifying information indicative of the prizes, said identifying information being attached to the prizes and read by a reading means into said input unit.

7. The prize acquisition game apparatus according to claim 6, wherein said control means compares said exchangeable members notified on said notification means with exchangeable members currently mounted on the catching unit, and, when these do not coincide, causes said notification means to make a notification to such effect.

8. A prize acquisition game apparatus, comprising:

a housing configured to provide a closed space in which prizes are displayed;

a console provided outside of said closed space with switches operable by a player who tries to get one of the prizes;

a catching unit arranged movably inside said closed space in responding to an external operation on said console by the player, said catching unit being provided with a set of movable catching arms configured exchangeably mountable to said catching unit, said catching arms being configured to allow a maintenance operator for the apparatus to removably mount them by selecting a set of said catching arms from a storage in which exchangeable members including plural sets of alternative catching arms are provided differently from one another at least in sizes:

a notification unit configured to notify a recommended type of said catching arms to be mounted to said catching unit so as to allow the maintenance operator to mount said recommended type of said catching arms to said catching unit;

a driving mechanism configured to movably support said catching unit in said closed space so as to move said catching unit in responding to an operation on said switches by the player and configured to make said catching arms open and close: and a configuration means arranged to control movement of said catching arms mounted in accordance with the type indicated on said notification unit.

9. A prize acquisition game apparatus, comprising:

a housing configured to provide a closed space in which prizes are arranged so that the prizes are seen through transparent walls wherein said walls include a maintenance door operable by a managing operator for the apparatus;

a console provided outside of said closed space with switches operable by a user player who tries to get one of the prizes while said maintenance door is closed;

a catching unit arranged inside said closed space and configured to be exchangeably mountable with catching arms, which are selected from reserves stored externally to said closed space to include plural sets of catching arms provided differently from one another at least in sizes;

a driving mechanism configured to move said catching unit laterally and vertically within said closed space in responding to an operation on said switches by the user player and configured to cause said catching arms to open and close;

a notification unit configured to notify information indicative of a set of recommended catching arms having a size applicable to prizes to be arranged in said closed space; and a configuration unit arranged to control the open and close movement of said catching arms based on configuration data set correspondingly to the size of said catching arms.

* * * * *